US011185206B2

(12) United States Patent
Hong et al.

(10) Patent No.: US 11,185,206 B2
(45) Date of Patent: Nov. 30, 2021

(54) DRUM FOR CLEANER AND CLEANER HAVING THE SAME

(71) Applicant: Samsung Electronics Co., Ltd., Suwon-si (KR)

(72) Inventors: Seok Man Hong, Suwon-si (KR); Sung Jin Park, Suwon-si (KR); Dong Wook Kim, Suwon-si (KR); Ki Hwan Kwon, Hwaseong-si (KR); Dong Woo Ha, Hwaseong-si (KR); Jin Wook Yoon, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 503 days.

(21) Appl. No.: 16/134,102

(22) Filed: Sep. 18, 2018

(65) Prior Publication Data

US 2019/0014966 A1 Jan. 17, 2019

Related U.S. Application Data

(63) Continuation of application No. 14/987,924, filed on Jan. 5, 2016, now Pat. No. 10,105,030.

(30) Foreign Application Priority Data

Nov. 16, 2015 (KR) ..... 10-2015-0160686

(51) Int. Cl.
*A47L 11/40* (2006.01)
*A47L 9/04* (2006.01)
(Continued)

(52) U.S. Cl.
CPC ..... *A47L 11/4041* (2013.01); *A47L 9/0477* (2013.01); *A47L 11/24* (2013.01);
(Continued)

(58) Field of Classification Search
CPC .... A47L 11/4041; A47L 9/0477; A47L 11/24; A47L 11/4005; A47L 11/4011;
(Continued)

(56) References Cited

U.S. PATENT DOCUMENTS 2,242,678 A 5/1941 Riebel, Jr.
5,611,109 A 3/1997 Worwag
(Continued)

FOREIGN PATENT DOCUMENTS

EP 2941994 11/2015
JP 4-200518 7/1992
(Continued)

OTHER PUBLICATIONS

European Communication under Rule 71(3) dated Oct. 25, 2018 in European Patent Application No. 16157244.1.
(Continued)

*Primary Examiner* — David Redding
(74) *Attorney, Agent, or Firm* — Staas & Halsey, LLP

(57) ABSTRACT

A cleaner includes a case which includes an inlet for suctioning in rubbish on a surface to be cleaned, a driver which is provided inside the case and includes a motor which generates power, a drum body which is provided in the inlet and configured to receive the power from the driver and rotate, and a drum blade arranged in an outer circumferential direction of the drum body and formed with a blade air current hole through which air suctioned in through the inlet passes.

23 Claims, 24 Drawing Sheets

(51) Int. Cl.
*A47L 11/24* (2006.01)
*A47L 9/06* (2006.01)

(52) U.S. Cl.
CPC ..... *A47L 11/4005* (2013.01); *A47L 11/4011* (2013.01); *A47L 11/4013* (2013.01); *A47L 11/4072* (2013.01); *A47L 9/0613* (2013.01); *A47L 2201/022* (2013.01); *A47L 2201/06* (2013.01)

(58) Field of Classification Search
CPC ..... A47L 11/4013; A47L 11/4072; A47L 9/0613; A47L 2201/022; A47L 2201/06; A47L 5/12; A47L 11/4002
See application file for complete search history.

(56) References Cited

U.S. PATENT DOCUMENTS

| | | | | |
|---|---|---|---|---|
| 8,881,339 | B2 | 11/2014 | Gilbert, Jr. | |
| 2012/0311813 | A1* | 12/2012 | Gilbert, Jr. ..... | A47L 11/4027 15/347 |
| 2013/0333129 | A1 | 12/2013 | Bradbury | |
| 2017/0172364 | A1 | 6/2017 | Eriksson | |

FOREIGN PATENT DOCUMENTS

| | | |
|---|---|---|
| JP | 7-178018 | 7/1995 |
| JP | 9-122048 | 5/1997 |
| JP | 11-206644 | 8/1999 |
| JP | 11-235296 | 8/1999 |
| JP | 2003-325396 | 11/2003 |
| JP | 2004-81893 | 3/2004 |
| JP | 2005-87644 | 4/2005 |
| JP | 2014-087385 | 5/2014 |
| KR | 10-2015-0080883 | 7/2015 |

OTHER PUBLICATIONS

Extended European Search Report dated Mar. 17, 2017 in European Patent Application No. 16157244.1.
U.S. Notice of Allowance dated Jun. 18, 2018 in U.S. Appl. No. 14/987,924.
U.S. Office Action dated Dec. 15, 2017 in U.S. Appl. No. 14/987,924.
U.S. Appl. No. 14/987,924, filed Jan. 5, 2016, Seok Man HONG, et al., Samsung Electronics Co., Ltd.
Chinese Office Action dated Mar. 9, 2020 in Chinese Patent Application No. 201610307787.5.

* cited by examiner

DRUM FOR CLEANER AND CLEANER HAVING THE SAME

CROSS-REFERENCE TO RELATED APPLICATIONS

This application is a continuation application of U.S. patent application Ser. No. 14/987,924, filed on Jan. 5, 2016, which claims the priority benefit of Korean Patent Application No. 10-2015-0160686, filed on Nov. 16, 2015 in the Korean Intellectual Property Office, the disclosure of which is incorporated herein by reference.

BACKGROUND

1. Field

The following description relates to a cleaner, and more particularly, to a cleaner having a drum blade.

2. Description of the Related Art

Cleaners are apparatuses for tidily removing indoor rubbish. In homes, vacuum cleaners are generally used. Vacuum cleaners clean by suctioning air in using suction force of an air blower and then separating rubbish in the suctioned air using a device such as a filter. As examples of the vacuum cleaners described above, there are a canister type and an upright type. Recently, robot cleaners have become popular, which autonomously run over a cleaning area and suction in rubbish such as dust from a surface to be cleaned to perform a cleaning operation without a user involvement.

Such cleaners include a bottom surface inlet through which to suction in rubbish on a floor surface.

Until recently, a drum brush was rotatably provided at the inlet to help scatter the rubbish on the floor surface into a cleaner. However, in the case of a sole type drum brush, fibrous dust such as threads or hair gets tangled on a surface of the drum brush causing an inconvenience to a user to remove the fibrous dust and causing cleaning efficiency to decrease.

To overcome such limitations, a drum including a plate-shaped drum blade has been suggested. However, rubbish is unable to be suctioned at a point where an air current generated by a suctioning air blower opposes an air current generated by the drum blade rotation. Also, noise occurs when the drum blade comes in contact with a surface to be cleaned, and power consumption for driving the drum increases as an area in which the drum blade is in contact with the surface to be cleaned is increased.

SUMMARY

Therefore, it is an aspect of the present disclosure to provide a cleaner improved in cleaning performance.

It is an aspect of the present disclosure to provide a cleaner capable of preventing a decrease in cleaning efficiency caused by a tangle of fibrous dust.

It is an aspect of the present disclosure to provide a cleaner capable of improving cleaning performance by providing a flow channel to allow rubbish and/or air suctioned in through an inlet to move into the cleaner.

It is an aspect of the present disclosure to provide a cleaner capable of reducing noise caused by a contact between a drum blade and a floor surface.

It is an aspect of the present disclosure to provide a cleaner capable of reducing power consumption.

Additional aspects of the disclosure will be set forth in part in the description which follows and, in part, will be obvious from the description, or may be learned by practice of the disclosure.

In accordance with one aspect of the present disclosure, a cleaner includes a case which includes an inlet for suctioning in rubbish on a surface to be cleaned, a driver which is provided inside the case and includes a motor which generates power, a drum body which is provided in the inlet and configured to receive the power from the driver and rotate, and a drum blade arranged in an outer circumferential direction of the drum body and formed with a blade air current hole through which air suctioned in through the inlet passes.

The drum blade may extend outward from an outer circumferential surface of the drum body in a radial direction of the drum body to be in contact with the surface to be cleaned.

A plurality of such blade air current holes may be provided in a longitudinal direction of the drum body.

A plurality of such drum blades may be provided in the outer circumferential direction of the drum body.

The cleaner may further include a drum brush which is disposed between each of the plurality of drum blades in the outer circumferential direction of the drum body and includes a plurality of brushes which extend outward from an outer circumferential surface of the drum body in a radial direction of the drum body.

The cleaner may further include a plate blade which is disposed between each of the plurality of drum blades in the outer circumferential direction of the drum body and extends outward from an outer circumferential surface of the drum body in a radial direction of the drum body.

The blade air current hole may include at least one of a circular shape and a honeycomb shape.

The drum blade may be provided to increasingly shift forward in the rotation direction going from central portion to both ends the drum body 610 along the longitudinal direction.

The drum blade may include a viscoelastic material.

The drum blade may further include a body air current hole formed penetrating the drum body in a radial direction thereof.

A plurality of such body air current holes may be provided in a longitudinal direction of the drum body.

One end of the drum blade may be rotatably connected to the drum body to allow the drum blade to rotate around the one end as the drum body rotates and another end opposite the one end may be pointing away from the drum body.

The cleaner may further include a connecting member which rotatably connects the drum blade with the drum body. Here, the drum blade may include a blade connecting portion provided at the one end to allow the connecting member to be rotatably coupled therewith, and the drum body may include fixing portions which fix the connecting member at both ends thereof.

The drum body may include a mounting groove on an outer circumferential surface thereof, on which the drum blade is rotatably mounted.

The drum blade may include a restricting portion which restricts a radius during rotation of the drum blade about the drum body.

The drum blade may be slanted along a longitudinal direction of the drum body.

The drum blade may include a plurality of blade segments disposed on both sides of the blade air current hole in a longitudinal direction of the drum body.

In accordance with an aspect of the present disclosure, a cleaner includes a case which includes an inlet for suctioning in rubbish on a surface to be cleaned, a driver which is provided inside the case and includes a motor which generates power, a drum body which is provided in the inlet and configured to receive the power from the driver and rotate, and a drum blade which includes one end rotatably connected to the drum body and is unfolded outward in a radial direction of the drum body as the drum body rotates.

The cleaner may further include a connecting member which rotatably connects the drum blade with the drum body. Here, the drum blade may include a connecting member coupling hole provided at the one end to allow the connecting member to be rotatably coupled therewith, and the drum body may include fixing portions which fix the connecting member on an outer circumferential surface thereof.

The drum body may include a mounting groove on an outer circumferential surface thereof, on which the drum blade is rotatably mounted.

In accordance with an aspect of the present disclosure, a drum for a cleaner includes a drum body which has a cylindrical shape, a drum blade which extends outward from an outer circumferential surface of the drum body in a radial direction of the drum body, and at least one blade air current hole provided in the drum blade and formed in a longitudinal direction of the drum body.

The drum may further include a connecting member which rotatably couples the drum blade with the drum body.

The drum blade may include a blade coupling portion at one end connected to the drum body to allow the connecting member to be rotatably coupled therewith, and the drum body may include a fixing portion which fixes the connecting member on the outer circumferential surface.

The drum body may include a mounting groove on the outer circumferential surface thereof, on which the drum blade is rotatably mounted.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
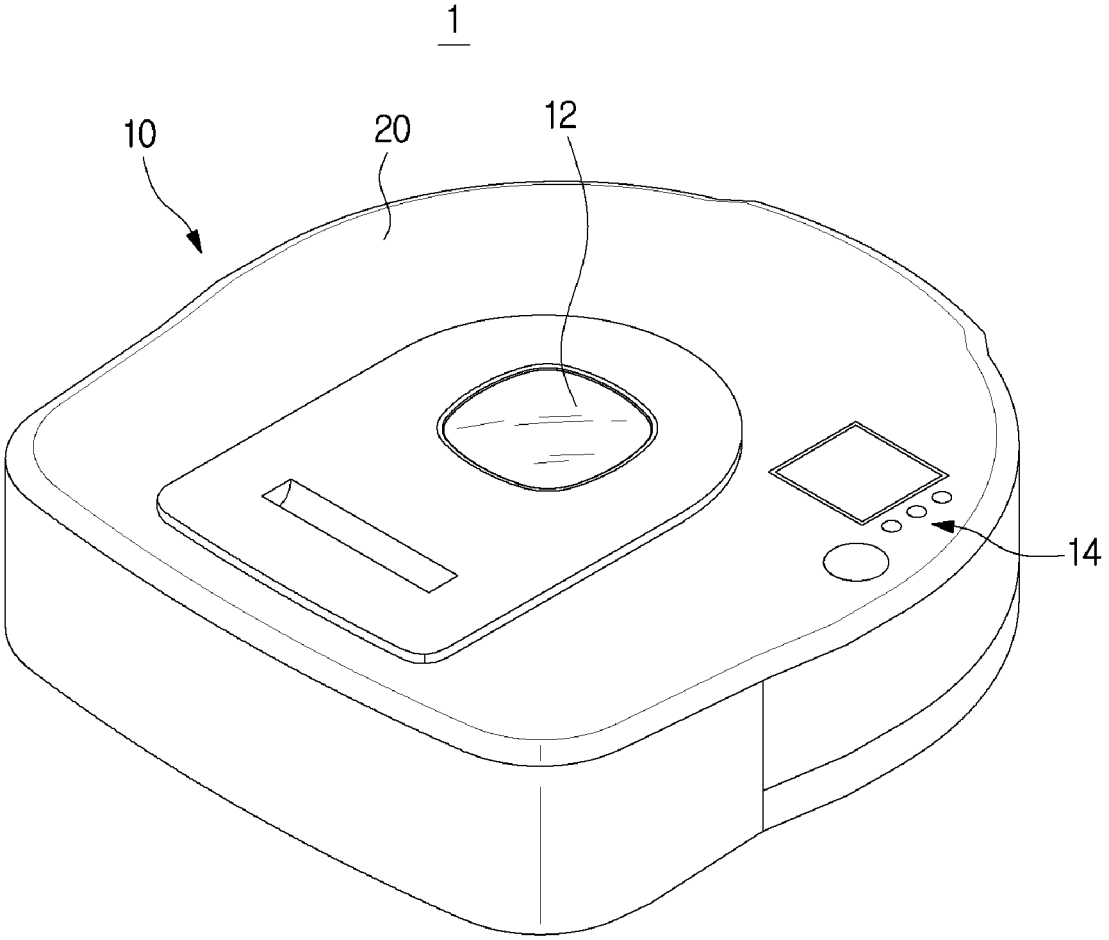
FIG. 1 is a perspective view of a cleaner in accordance with an embodiment of the present disclosure.

Reference will now be made in detail to the embodiments, examples of which are illustrated in the accompanying drawings, wherein like reference numerals refer to like elements throughout. The embodiments are described below to explain the present disclosure by referring to the figures.

Embodiments described herein and configurations shown in the drawings are merely exemplary examples. Also, various modified examples with which these embodiments and the drawings could be replaced may be present at the time of filing of the present application.

Also, throughout the drawings, like reference numerals designate like elements.

Also, terms used herein are to describe the embodiments but do not intend to restrict and/or limit the disclosed disclosure. Singular expressions, unless defined otherwise in contexts, include plural expressions. Throughout the specification, the terms "comprise" or "have", etc. are used herein specify the presence of stated features, numbers, steps, operations, elements, components, or combinations thereof but do not preclude the presence or addition of one or more other features, numbers, steps, operations, elements, components, or combinations thereof.

Also, it will be understood that although the terms "first", "second", etc. may be used herein to describe various components, these components should not be limited by these terms. These terms are only used to distinguish one component from another. For example, without departing from the scope of the present disclosure, a first component may be designated as a second component, and similarly, the second component may be designated as the first component. The term "and/or" includes any and all combinations or one of a plurality of associated list of items.

Meanwhile, the terms used hereafter such as "a front end", "a rear end", "a top", "a bottom", "a top end", and "a bottom end" are defined based on the drawings. However, shapes and positions of respective components will not be limited thereto.

Hereinafter, embodiments of the present disclosure will be described in detail with reference to the attached drawings.

Figure 2:
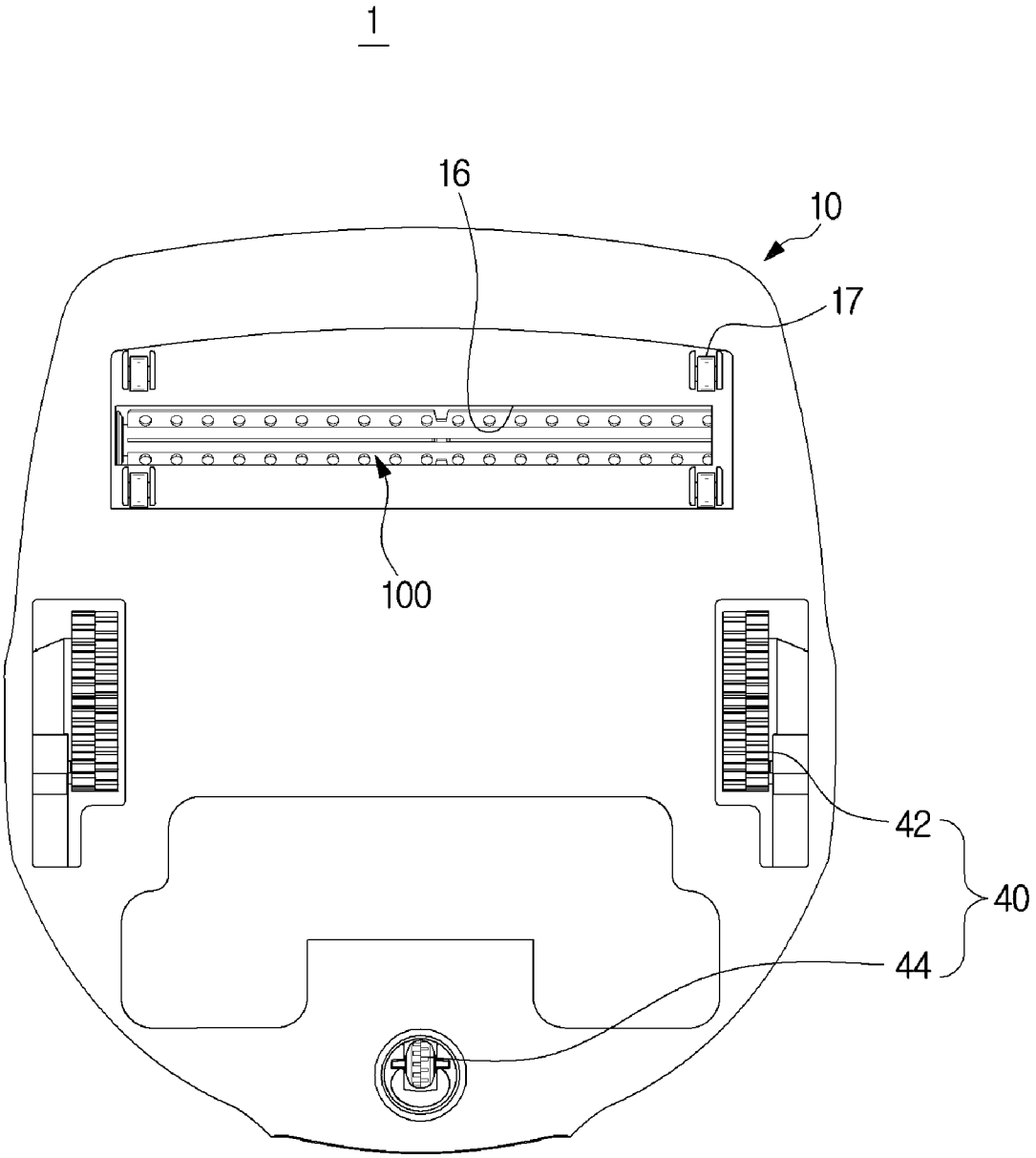
FIG. 2 is a bottom view of the cleaner of FIG. 1.
Figure 3:
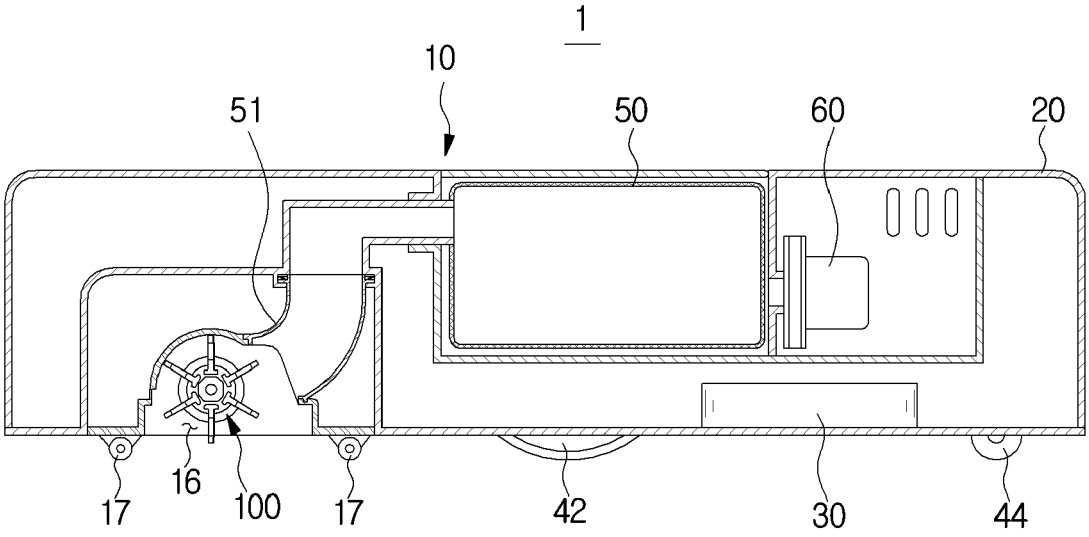
FIG. 3 is a schematic cross-section view of the cleaner of FIG. 1.

FIG. 1 is a perspective view of a cleaner 1 in accordance with an embodiment of the present disclosure. FIG. 2 is a bottom view of the cleaner 1 of FIG. 1. FIG. 3 is a schematic cross-section view of the cleaner 1 of FIG. 1.

Referring to FIGS. 1 to 3, the cleaner 1 in accordance with an embodiment of the present disclosure will be described.

The cleaner 1 is a robot cleaner and may include a case 10 which forms an external shape, a cover 20 which covers a top of the case 10, a drum 100 which sweeps or scatters rubbish present on a surface to be cleaned, a driver 30 which supplies driving power for driving the cleaner 1, and a driving unit 40 which drives the cleaner 1.

The case 10 forms the external shape of the cleaner 1 while providing structural support for various components installed therein. The case 10 may be provided as a cylindrical shape. When rotating, the cylindrical case 10 has a uniform radius of rotation, thereby helping to avoid contacts with other surrounding obstacles and easily changing a direction thereof. Also, it is possible to prevent the cleaner 1 from being immobilized while driving due to obstacles.

A display portion 12 may be provided on a top side of the case 10. The display portion 12 may display various pieces of information, such as an operation state of the cleaner 1, a dust amount, a battery charge amount, time, etc.

An input portion 14 may be provided on the top side of the case 10. The input portion 14 may allow a user to input a command for controlling the cleaner 1. The input portion 14 may be a button to be pressed by the user to input the command or may be a touch screen to allow command to be input by touching the input portion 14.

An inlet 16 may be provided at a bottom side of the case 10. The inlet 16 is provided to suction in and move the rubbish present on the floor surface to a dust collecting member 50 which will be described below. The inlet 16 may be provided in an oblong shape.

At least one supporting unit 17 may be provided at the bottom side of the case 10. The supporting unit 17 may be provided to space the inlet 16 at a predetermined distance from the surface to be cleaned. When the inlet 16 is in close contact with the surface to be cleaned, it is difficult for outside air and rubbish to flow into the cleaner 1. That is, to prevent deterioration of suction efficiency due to the inlet 16 from being in contact with the surface to be cleaned, the supporting unit 17 is provided to support the cleaner 1 to space the inlet 16 at the predetermined distance from the surface to be cleaned.

The supporting unit 17 is provided to support the case 10 to allow the inlet 16 to be located higher than the surface to be cleaned. One or more supporting unit 17 may be provided along a circumference of the inlet 16. The supporting unit 17 may be rotatably provided at a bottom of the case 10 and may support the case 10 to space the inlet 16 at the predetermined distance from the surface to be cleaned.

In the embodiment, the supporting unit 17 has a roller shape and a plurality of such supporting units 17 are disposed along the circumference of the inlet 16 to space the inlet 16 at the predetermined distance from the surface to be cleaned. Because the supporting unit 17 is formed in the shape of a roller, the cleaner 1 may move in all directions. However, the shape and arrangement of the supporting units 17 are not limited thereto, and the supporting unit 17 may be provided in any configuration which supports the case 10 to space the inlet 16 from the surface to be cleaned.

The cleaner 1 may further include a sensor unit (not shown). The sensor unit may sense peripheral geographical features, may recognize a position of the cleaner 1, and may sense obstacles. The sensor unit may include a plurality of sensors. The plurality of sensors may be provided in mutually exclusive positions in the case 10.

The driving unit 40 may be provided to move the cleaner 1. The driving unit 40 may include a driving wheel 42 provided at the bottom side of the case 10. A plurality of such driving wheels 42 may be provided. A pair of the driving wheels 42 may be symmetrically disposed on both left and right edges of a central portion of the bottom side of the case 10. The driving wheels 42 may be provided to move forward and backward and spin while the cleaner 1 performs cleaning. The driving wheels 42 may be driven by a motor.

The driving unit 40 may further include a caster 44. The caster 44 may be provided at the bottom side of the case 10 in the front or rear of the driving wheels 42. The caster 44 may be provided to make driving in all directions possible. The caster 44 may be provided to allow a change in direction of the cleaner 1 to be smoothly performed.

The driver 30 is electrically connected to the driving unit 40, the drum 100 which will be described below, and other components for driving the cleaner 1 to supply electricity thereto. The driver 30 may be provided to include a battery and to receive power from a docking station (not shown) to be charged when the cleaner 1 is coupled with the docking station after completing a cleaning operation. In addition, the driver 30 may include a motor (not shown) for driving the drum 100.

The drum 100 may be disposed in the inlet 16 to face the surface to be cleaned. The drum 100 is rotatably provided to sweep or scatter rubbish on the surface to be cleaned to pick the rubbish into the cleaner 1. The drum 100 will be described below in detail.

The cleaner 1 may include the dust collecting member 50 and a suction motor 60.

The dust collecting member 50 is provided within the case 10 to form a space for collecting rubbish suctioned from the outside. The suction motor 60 is provided within the case 10 to generate a suction force and suctions in the rubbish on the surface to be cleaned through the inlet 16 using the suction force to allow the rubbish to be collected in the dust collecting member 50 through a dust collecting member connecting pipe 51 that connects the dust collecting member 50 with the inlet 16.

Figure 4:
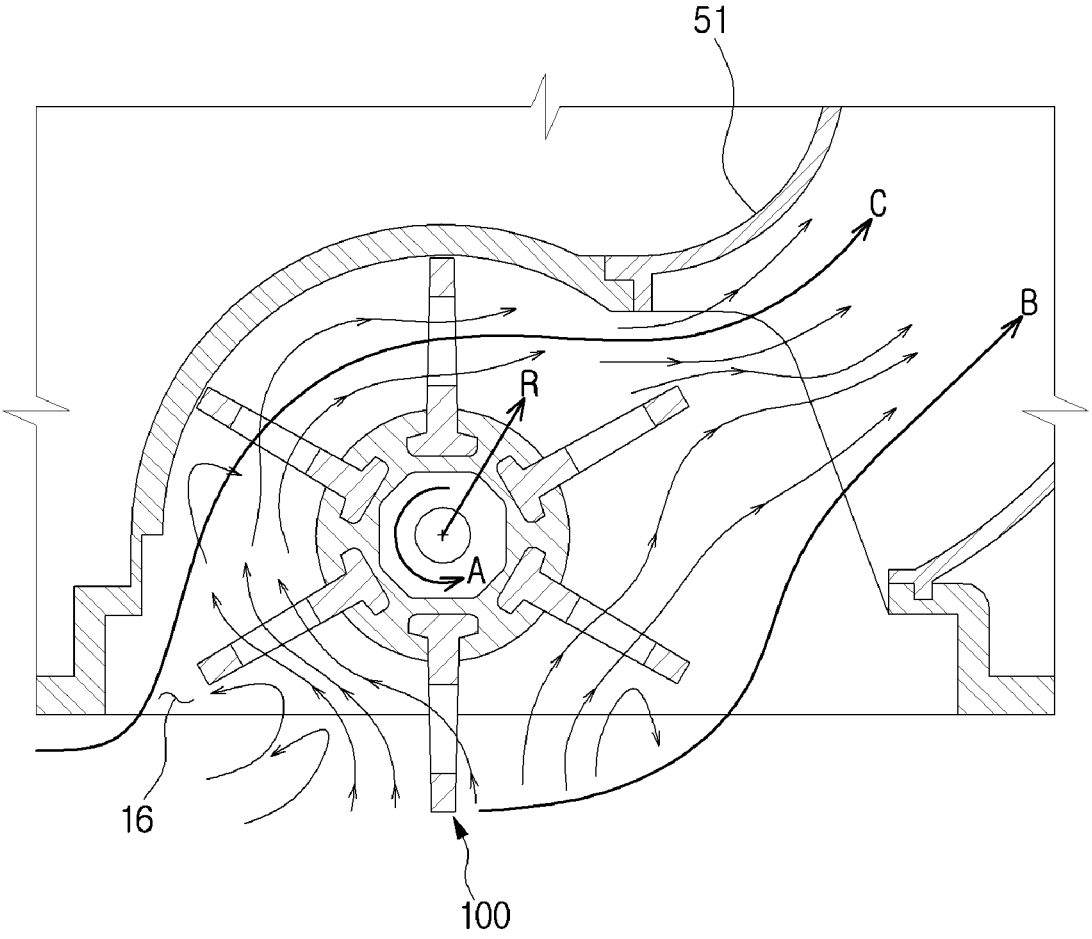
FIG. 4 is a view illustrating an air current at an inlet shown in FIG. 3.
Figure 5:
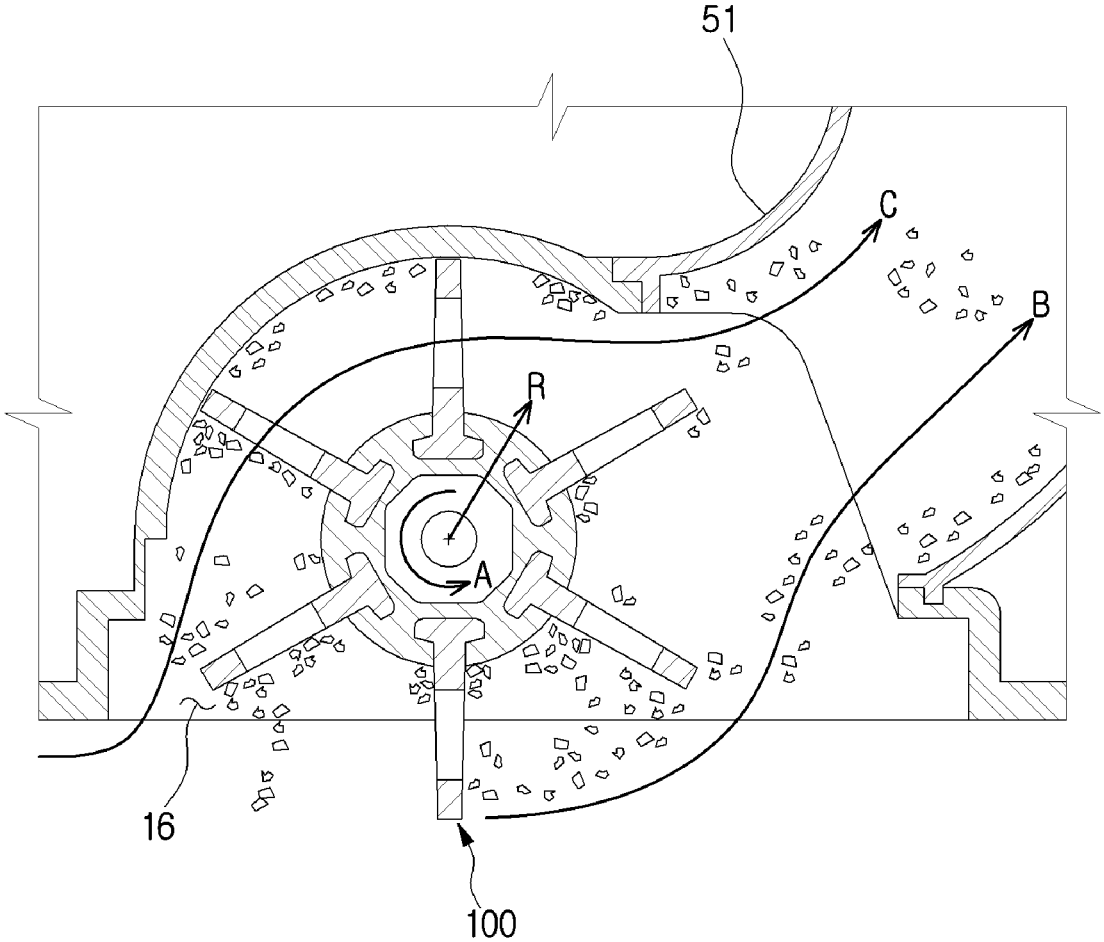
FIG. 5 is a view illustrating a movement of rubbish at the inlet shown in FIG. 3.
Figure 6:
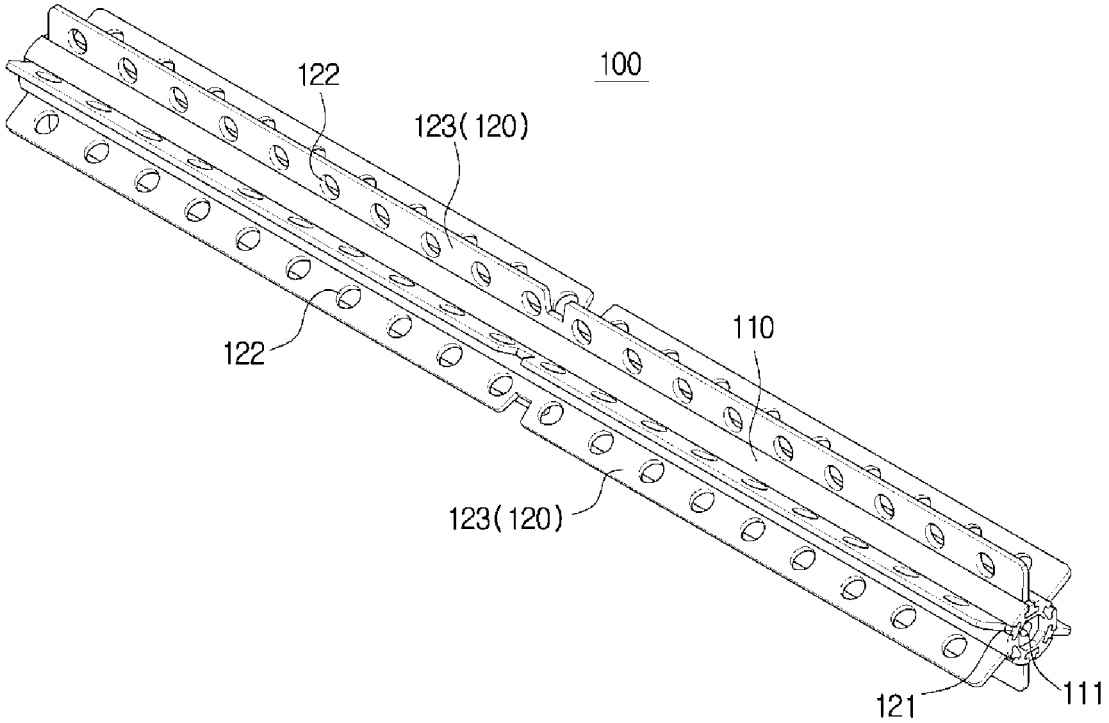
FIG. 6 is a view of a drum shown in FIG. 2.
Figure 7:
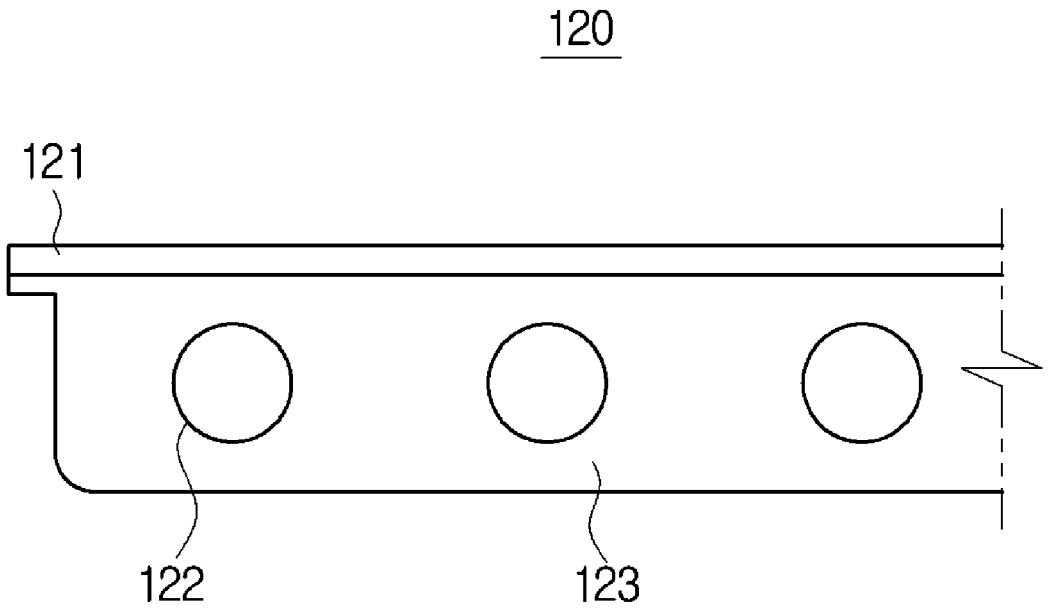
FIG. 7 is a partial view of a drum blade shown in FIG. 6.
Figure 8:
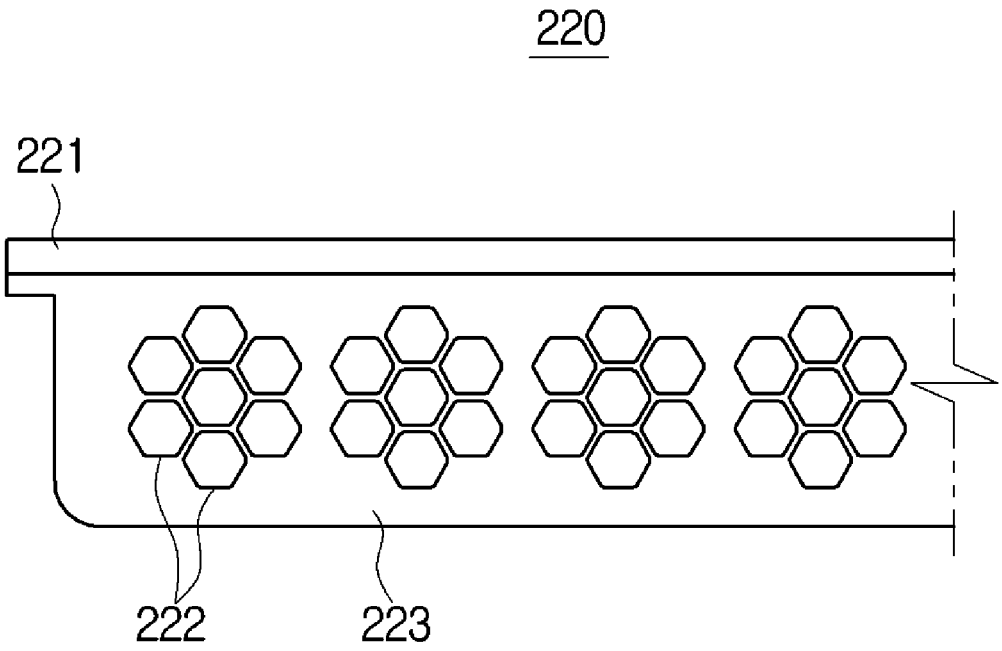
FIG. 8 is a view illustrating an example of the drum blade shown in FIG. 7.
Figure 9:
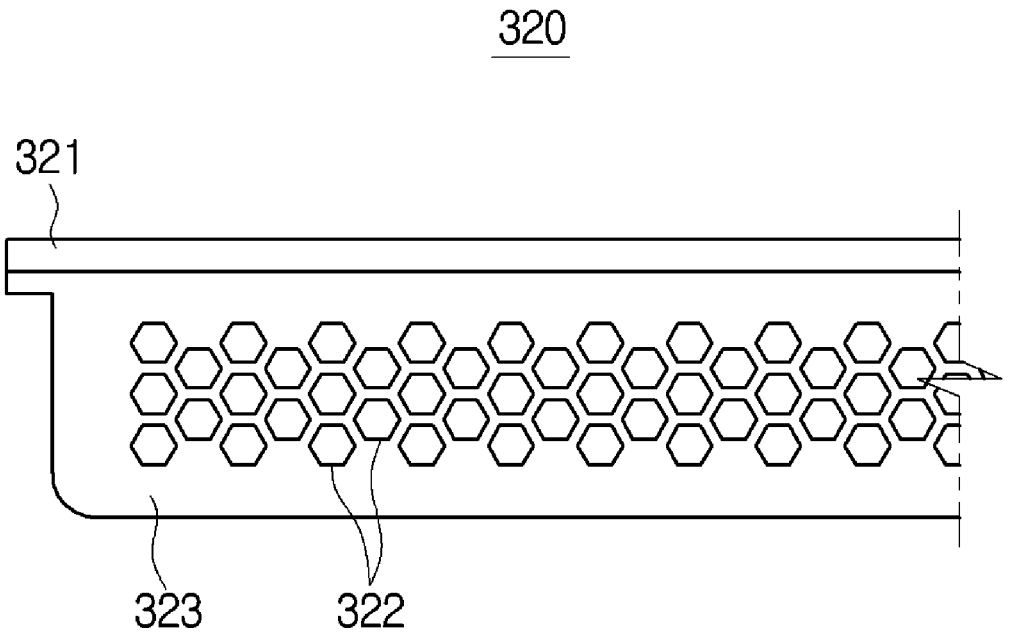
FIG. 9 is a view illustrating an example of the drum blade shown in FIG. 7.

FIG. 4 is a view illustrating an air current at the inlet 16 shown in FIG. 3. FIG. 5 is a view illustrating a movement of rubbish at the inlet 16 shown in FIG. 3. FIG. 6 is a view of the drum 100 shown in FIG. 2. FIG. 7 is a partial view of a drum blade 120 shown in FIG. 6. FIG. 8 is a view illustrating an example of the drum blade 120 shown in FIG. 7. FIG. 9 is a view illustrating an example of the drum blade 120 shown in FIG. 7.

The drum 100 is rotatably provided in the inlet 16 in the case 10 and provided to pick up the rubbish on the surface to be cleaned into the cleaner 1. The drum 100 may be provided to rotate around a rotating shaft and to allow a part thereof to be in contact with the surface to be cleaned.

The drum 100 includes a drum body 110 which rotates around an axis and a drum blade 120 provided on an outer circumferential surface of the drum body 110. The drum 100 is driven by receiving power from the driver 30. While the cleaner 1 performs the cleaning operation, the drum body 110 may scatter and pick up dust and/or rubbish present on the surface to be cleaned into the cleaner 1 while driving with the drum blade 120.

The drum body 110 is rotatably provided in the inlet 16. The drum body 110 is configured to rotate by receiving power from the driver 30. The drum body 110 may be formed in a cylindrical shape and may include a plurality of blade coupling grooves 111 which extend in a longitudinal direction of the drum body 110 and are provided in a radial direction R of the drum body 110 on an outer circumferential surface thereof. The number and shape of the blade coupling grooves 111 may correspond to the number and shape of the drum blades 120 which will be described below. The number of the blade coupling grooves 111 is six corresponding to the number of the drum blades 120 in FIG. 6 but is not limited thereto. When the number of the drum blades 120 is 7 or more or 5 or less, the number of the blade coupling grooves 111 may correspond thereto. Also, corresponding to one drum blade 120, only one blade coupling groove 111 may be provided.

The drum blades 120 may extend outward from the outer circumferential surface of the drum body 110 in the radial direction R of the drum body 110 (refer to FIGS. 4 and 5). The drum blades 120 may be formed including a viscoelastic material. Accordingly, when the drum blade 120 beats the surface to be cleaned, the drum blade 120 is deformed and may be in surface contact with the surface to be cleaned. The drum blade 120 may have a length approximately the same as a length of the drum body 110. Also, in FIG. 6, one drum blade 120 is disposed in the longitudinal direction of the drum body 110. However, a plurality of such drum blades 120 may be disposed in the longitudinal direction of the drum body 110. That is, the drum blade 120 may be provided to include a plurality of blade segments.

Also, the plurality of drum blades 120 may be disposed to be spaced at predetermined intervals in the longitudinal direction of the drum body 110. The number of the drum blades is six in FIG. 6 but is not limited thereto and may be 7 or more, 5 or less, or may be only one.

One end of the drum blade 120 described above may be connected to the drum body 110 and a part of another end may be in contact with the surface to be cleaned to beat the surface to be cleaned. Accordingly, the rubbish present on the surface to be cleaned may be scattered and swept into the cleaner 1 through the inlet 16.

The drum blade 120 may include a blade coupling portion 121 provided at one end thereof to be coupled and fixed to the blade coupling groove 111 of the drum body 110. As the blade coupling portion 121 of the drum blade 120 is coupled with the blade coupling groove 111 of the drum body 110, the drum blade 120 may be coupled and fixed to the drum body 110.

The drum blade 120 may include a blade air current hole 122 formed in a blade body 123 for leading rubbish into the cleaner 1. The blade air current hole 122 may be formed in a flow channel through which air and/or rubbish suctioned through the inlet 16 moves to the dust collecting member 50. The blade air current hole 122, as shown in FIG. 7, may have a circular shape and may be provided as a plurality of blade air current holes 122 in the longitudinal direction of the drum body 110.

However, the shape of the blade air current hole 122 is not limited to the circular shape shown in FIG. 7.

In detail, referring to FIG. 8, a drum blade 220 may include a blade air current hole 222 having a honeycomb shape.

The drum blade 220 includes a blade coupling portion 221 provided at one end thereof and connected and fixed to the blade coupling groove 111 of the drum body 110. Also, the drum blade 220 includes a blade body 223 which extends from one end toward one side to sweep rubbish into the cleaner 1. The blade air current hole 222 is provided in a hexagonal shape and may be provided in the honeycomb shape in the blade body 223. In detail, the seven blade air current holes 222 may form the honeycomb shape and a plurality of such honeycomb shapes may be provided in a longitudinal direction of the blade body 223.

Also, referring to FIG. 9, in the case of a drum blade 320, including a blade coupling portion 321 provided at one end thereof, a plurality of hexagonal shaped blade air current holes 322 may be provided in repeating columns or rows in a longitudinal direction of the blade body 323 without forming the honeycomb shape shown in FIG. 8.

As described above, the blade air current holes 122, 222, and 322 may be configured in various shapes, numbers, and arrangements, and a combination of the shapes, numbers, and arrangements shown in FIGS. 7 to 9 may be available.

Referring to FIGS. 3 to 5, a suction operation of the cleaner 1 in accordance with an embodiment of the present disclosure will be described.

When the user inputs a command for starting the cleaning operation using the input portion 14, cleaner 1 starts performing the cleaning operation. Here, the user may input the command to the cleaner 1 using a remote controller instead of the input portion 14.

The cleaner 1 suctions the rubbish present on the surface to be cleaned through the inlet 16 while running on the surface to be cleaned. Here, the drum 100 beats the surface to be cleaned while rotating in an A direction to scatter the rubbish present on the surface to be cleaned. The scattered rubbish is swept together with air into the dust collecting member 50 due to the suction force of the suction motor 60. Here, because the drum 100 rotates in the A direction, almost all of the rubbish and air may be swept in a B direction into the dust collecting member 50.

Because a conventional drum does not include a blade air current hole in a drum blade, rubbish present on a surface to be cleaned and air cannot be swept in a C direction, thereby diminishing cleaning efficiency. However, because the cleaner 1 in accordance with an embodiment of the present disclosure includes the blade air current holes 122 in the drum blade 120 of the drum 100, the rubbish on the surface to be cleaned and air may also be swept in the C direction, thereby increasing cleaning efficiency.

Also, as the blade air current holes 122 are provided in the drum blade 120, a contact area between the drum blade 120 and the surface to be cleaned is reduced to reduce resistance between the drum blade 120 and the surface to be cleaned, thereby increasing the cleaning efficiency and reducing noise caused by friction between the drum blade 120 and the surface to be cleaned. In addition, the resistance between the drum blade 120 and the surface to be cleaned is reduced, resulting in reduced driving force for rotating the drum blade 120, thereby reducing power consumption.

Figure 10:
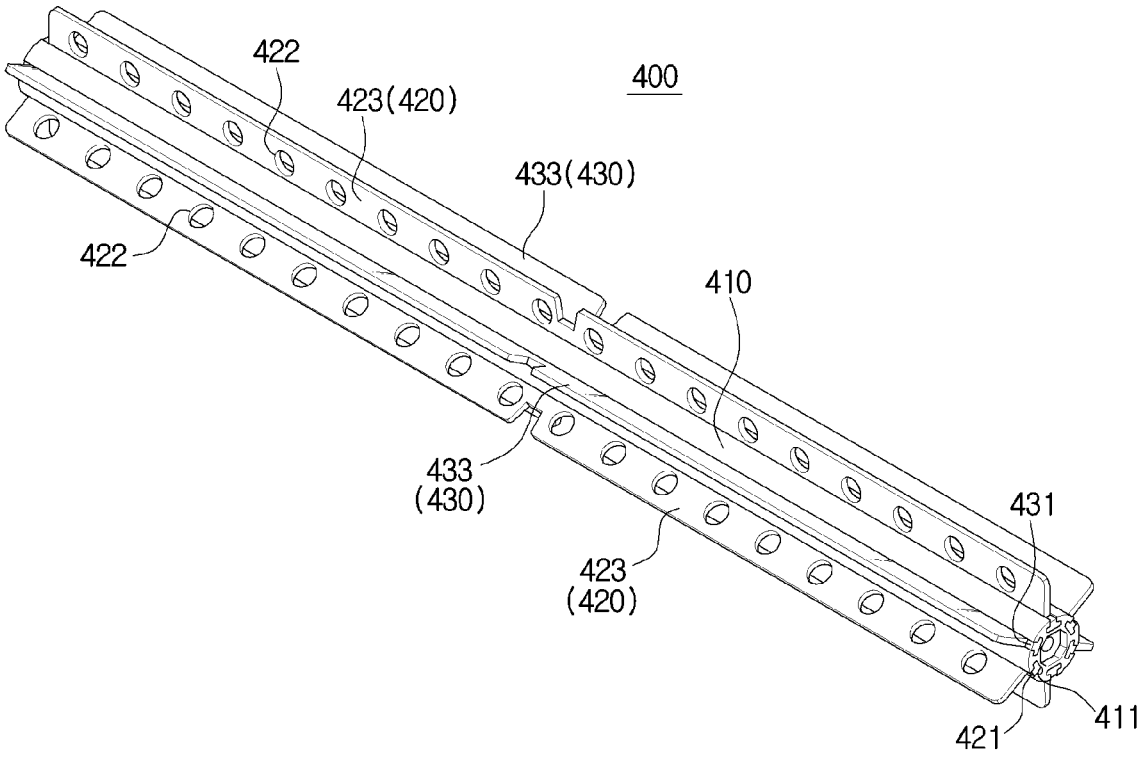
FIG. 10 is a view illustrating an example of the drum shown in FIG. 6.

FIG. 10 is a view illustrating an example of the drum 100 shown in FIG. 6.

Referring to FIG. 10, a drum 400 may include a drum body 410 which rotates around an axis, a drum blade 420 provided on an outer circumferential surface of the drum body 410, and a plate blade 430 provided between the drum blades 420 along the outer circumferential surface of the drum body 410.

The plate blade 430 may extend outward from the outer circumferential surface of the drum body 410 in a radial direction R of the drum body 410. The plate blade 430 may include a viscoelastic material like the drum blade 420. The drum blade 430 may have a length approximately the same as a length of the drum body 410.

The plate blade 430 may include a blade coupling portion 431 at one end. The blade coupling portion 431 may be coupled with a blade coupling groove 411 of the drum body 410. Accordingly, the plate blade 430 may be coupled and fixed to the drum body 410. The plate blade 430, unlike the drum blade 420, does not include a blade air current hole.

In FIG. 10, the drum 400 includes the three drum blades 420 and the three plate blades 430 disposed between the respective drum blades 420. However, the number and arrangement of the plate blades 430 are not limited thereto. That is, the drum blades 420 and the plate blades 430 may be irregularly arranged in an outer circumferential direction of the drum body 410, and the number of the drum blades 420 may be different from the number of the plate blades 430.

Like the example shown in FIG. 10, when the drum 400 includes the plate blade 430 disposed between the drum blades 420, a flow channel for sweeping rubbish on a surface to be cleaned and air into the dust collecting member 50 through the drum blades 420 may be formed and simultaneously much more rubbish may be scattered and swept into the dust collecting member 50 because of the plate blade 430.

Figure 11:
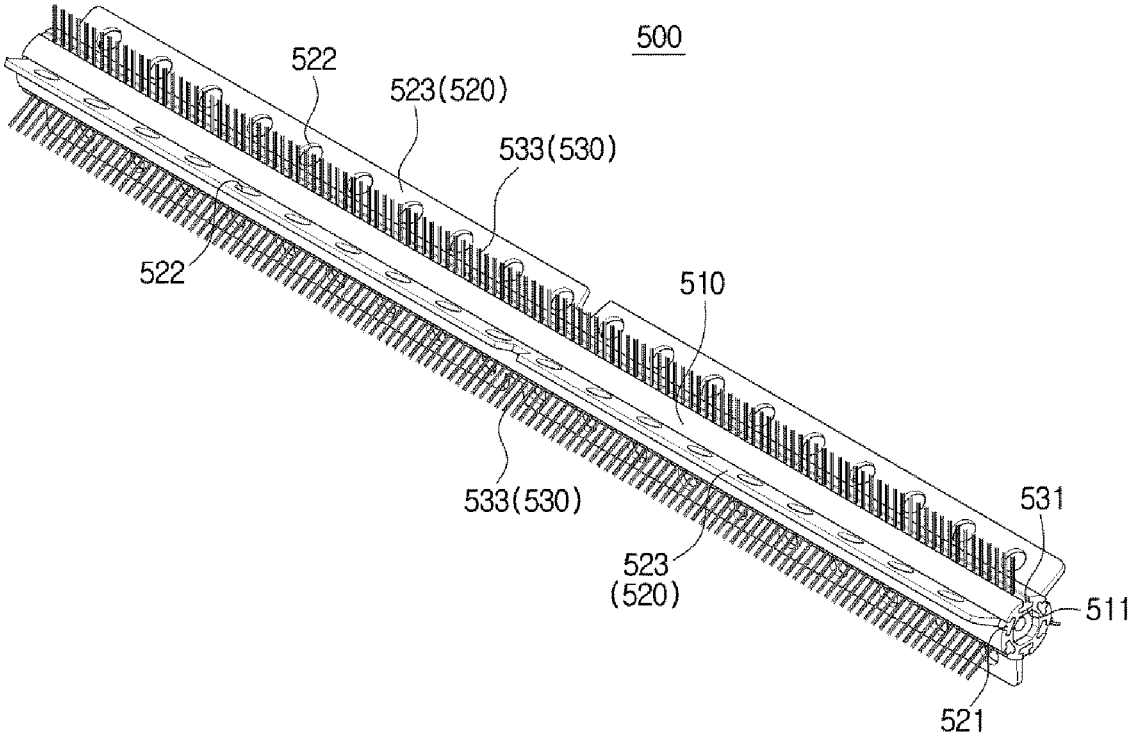
FIG. 11 is a view illustrating an example of the drum shown in FIG. 6.

FIG. 11 is a view illustrating an example of the drum 100 shown in FIG. 6.

Referring to FIG. 11, a drum 500 may include a drum body 510 which rotates around an axis, a drum blade 520 provided on an outer circumferential surface of the drum body 510, and a drum brush 530 provided between the drum blades 520 along the outer circumferential surface of the drum body 510.

The drum brush 530 may include a brush body 531 coupled with a brush coupling groove 511 of the drum body 510 and a plurality of brushes 533 which extend outward from the brush body 531 in a radial direction R of the drum body 510.

The brush body 531 may have a length approximately the same as a length of the drum body 510. The plurality of brushes 533 may be arranged on the brush body 531 in a longitudinal direction of the drum body 510 and may extend to a length in which the drum blade 520 extends outward in the radial direction R of the drum body 510.

When the drum 500 includes the drum brush 530 disposed between the drum blades 520 as shown in FIG. 11, a tangle of fibrous dust may be more effectively prevented compared to a general cleaner including only a drum brush.

In FIG. 11, the drum 500 includes the three drum blades 520 and the three drum brushes 530 disposed between the respective drum blades 520. However, the number and arrangement of the drum brushes 530 are not limited thereto. That is, the drum blades 520 and the drum brushes 530 may be irregularly arranged in an outer circumferential direction of the drum body 510, and the number of the drum blades 520 may be different from the number of the drum brushes 530.

Figure 12:
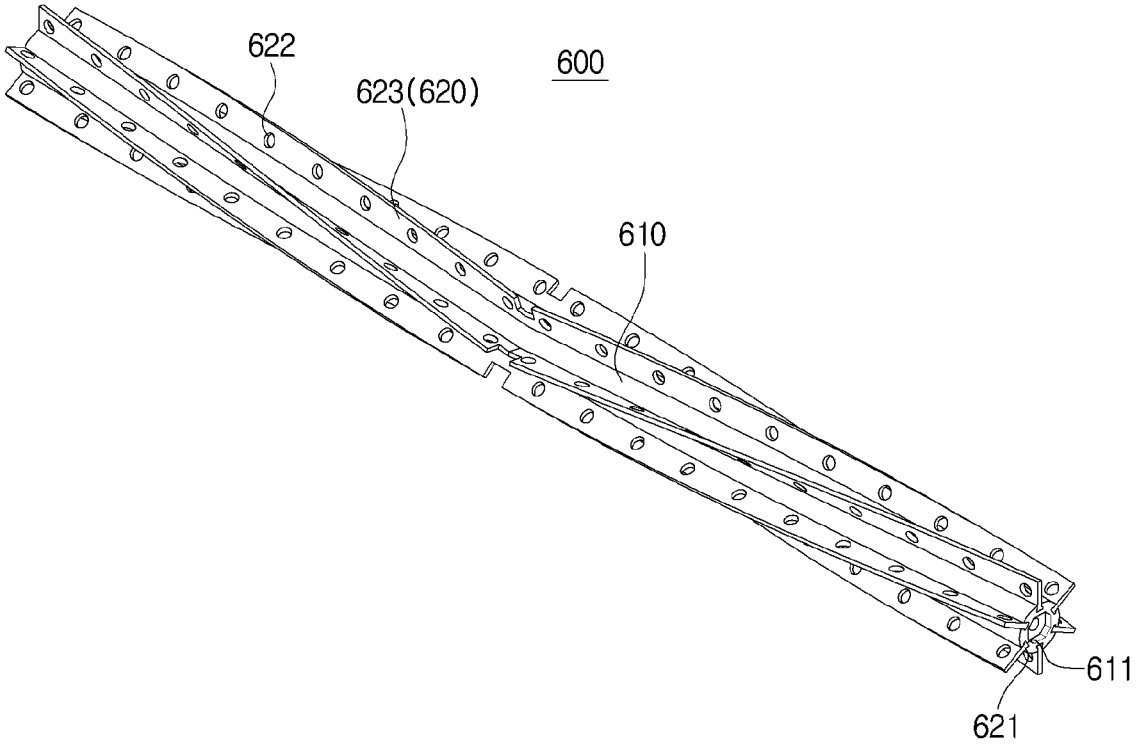
FIG. 12 is a view illustrating an example of the drum shown in FIG. 6.

FIG. 12 is a view illustrating an example of the drum 100 shown in FIG. 6.

Referring to FIG. 12, the drum 600 includes a drum body 610 which rotates around an axis and a drum blade 620 provided on an outer circumferential surface of the drum body 610.

In the example shown in FIG. 12, the drum blade 620 may be slanted toward a longitudinal direction of the drum body 610. The drum blade 620 may be provided to increasingly shift forward in the rotation direction going from a central portion to both ends the drum body 610 along the longitudinal direction. That is, when the drum 600 is viewed from a radial direction R, the drum blades 620 may be arranged in a V shape on the drum body 610.

When the drum 600 includes the drum blades 620 slanted toward the drum body 610 as shown in FIG. 12, the dust collecting member connection pipe 51 which connects the dust collecting member 50 with the inlet 16 is provided at an approximately central portion of the inlet 16, thereby sweeping rubbish present at both sides of the longitudinal direction of the drum body 610 towards a central portion of the drum body 610 to effectively suction into the dust collecting member 50.

Figure 13:
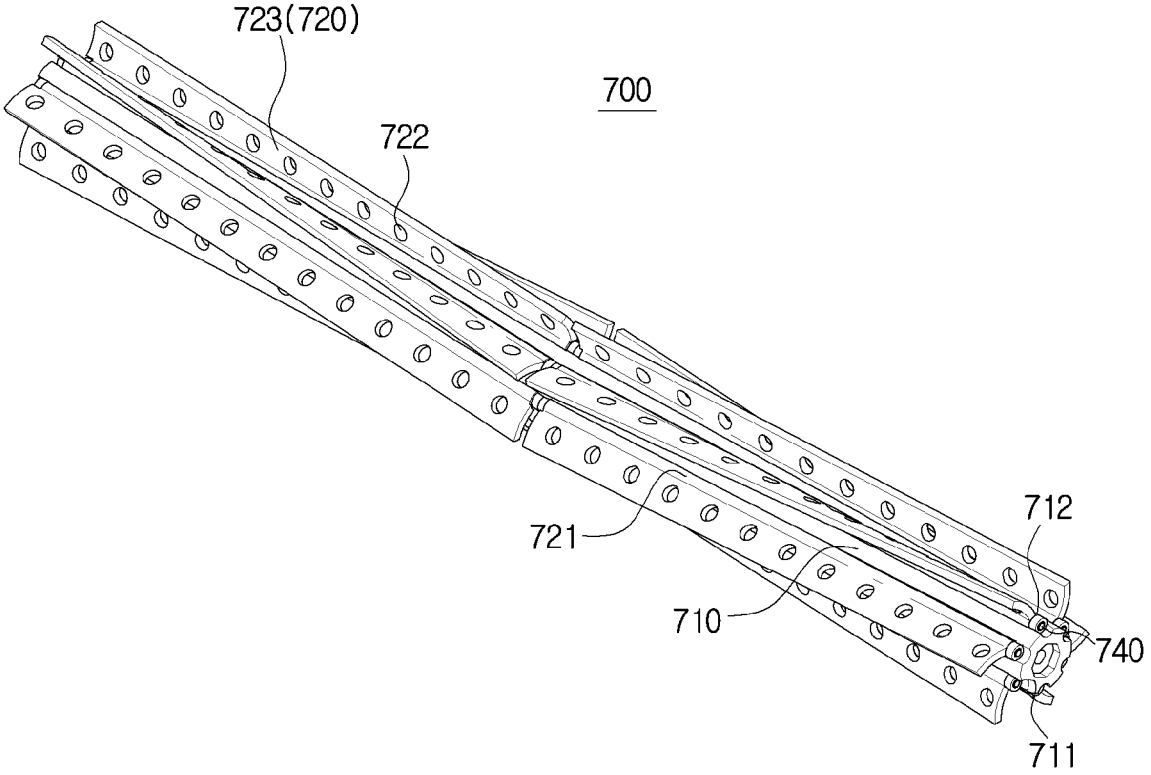
FIG. 13 is a view illustrating an example of the drum shown in FIG. 6.
Figure 14:
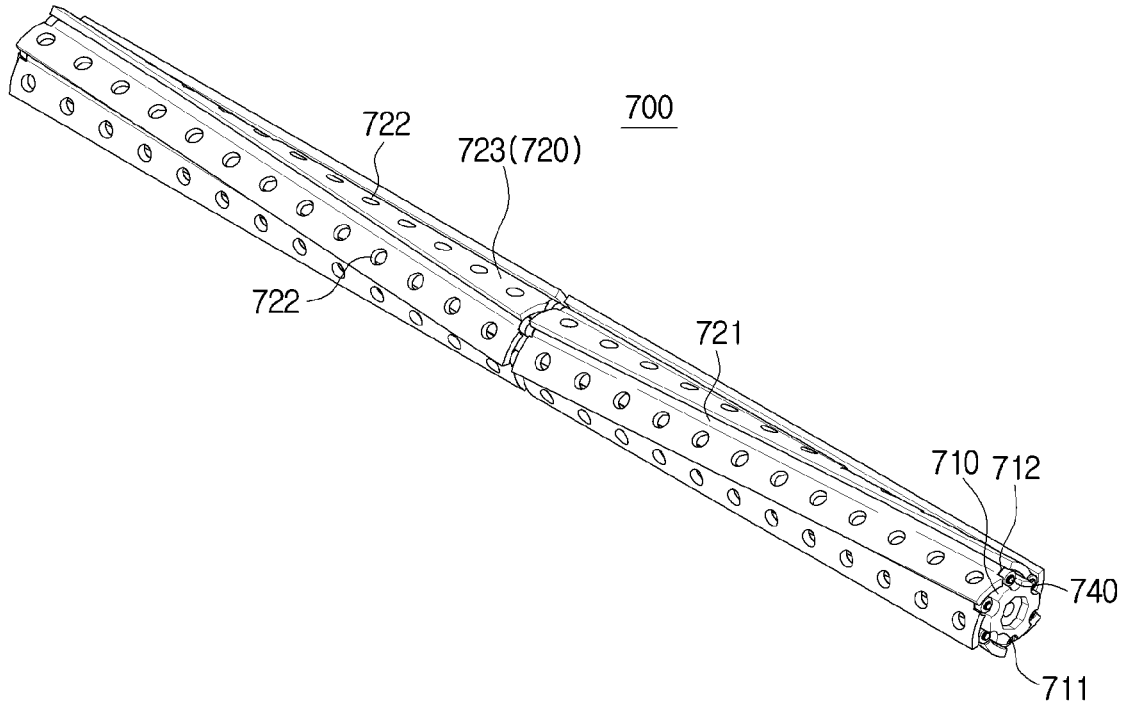
FIG. 14 is a view illustrating a state in which a drum blade shown in FIG. 13 is folded.
Figure 15:
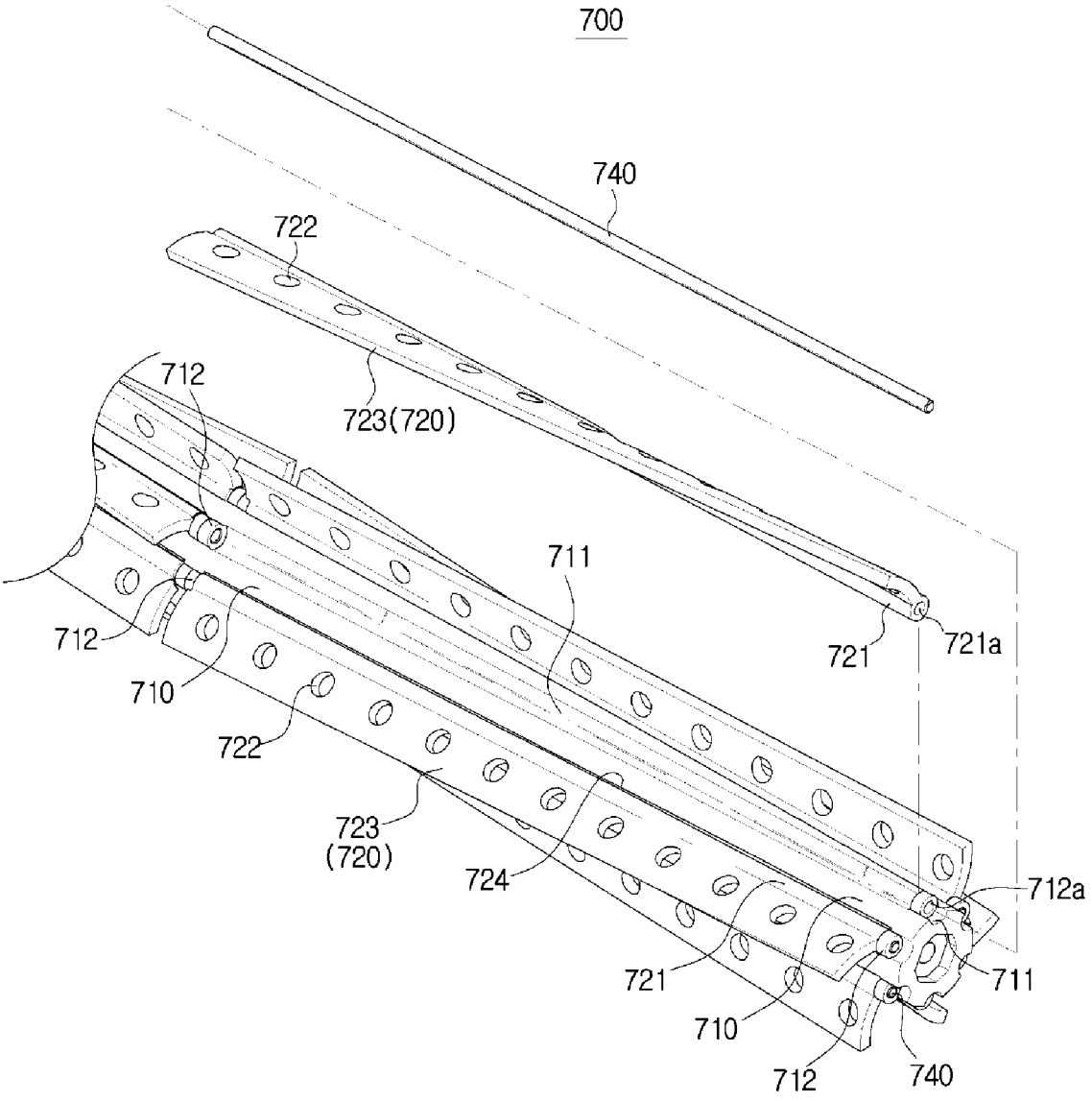
FIG. 15 is an exploded view of the drum shown in FIG. 13.
Figure 16:
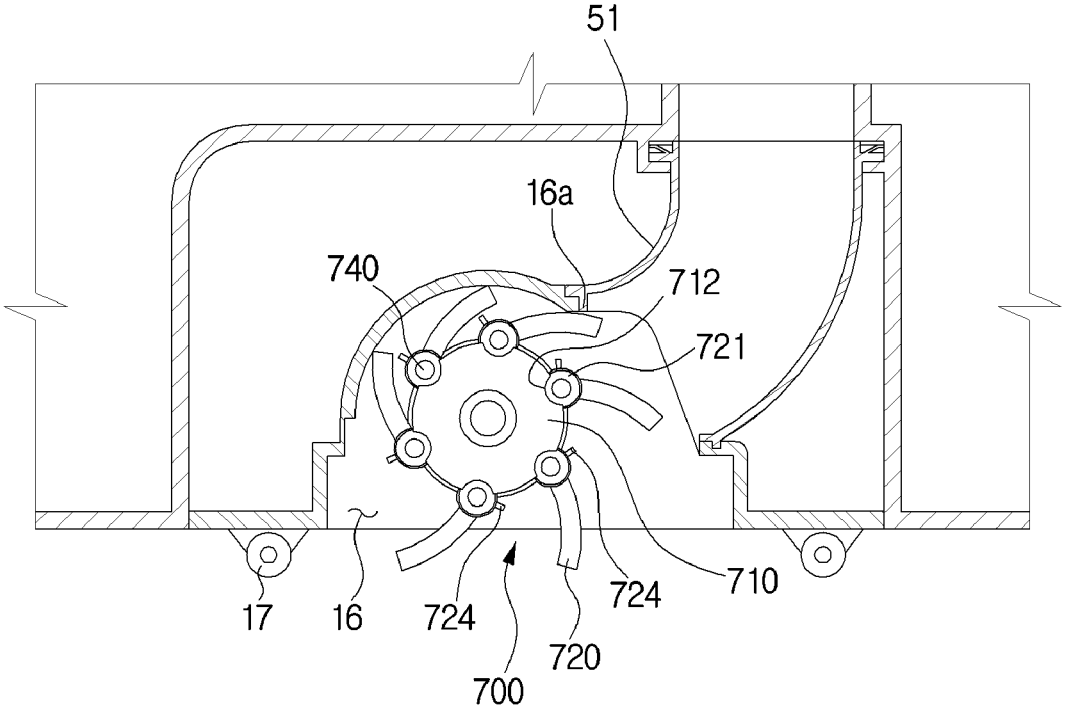
FIG. 16 is a view of the drum shown in FIG. 13 in a longitudinal direction.

FIG. 13 is a view illustrating an example of the drum 100 shown in FIG. 6. FIG. 14 is a view illustrating a state in which a drum blade 720 shown in FIG. 13 is folded. FIG. 15 is an exploded view of the drum 700 shown in FIG. 13. FIG. 16 is a view of the drum 700 shown in FIG. 13 in a longitudinal direction.

Referring to FIGS. 13 to 15, the drum 700 includes a drum body 710 which rotates around an axis and the drum blade 720 provided on an outer circumferential surface of the drum body 710.

The drum body 710 may include a mounting groove 711 on which the drum blade 720 is rotatably mounted. The mounting groove 711 may be provided in a shape and size corresponding to a shape of a blade coupling portion 721 of the drum blade 720. In detail, in the example shown in FIG. 13, the blade coupling portion 721 may have a circular cross section and the mounting groove 711 may have a concave shape corresponding thereto. The mounting groove 711 may extend in a longitudinal direction of the drum body 710.

The drum blade 720 may be rotatably connected to the drum body 710. The drum blade 720 may include a blade coupling portion 721 formed at one end thereof. The blade coupling portion 721 may allow the drum blade 720 to be rotatably connected to the drum body 710, together with a connecting member 740 which will be described below. Accordingly, the drum blade 720 may be configured to rotate around one end thereof at which the blade coupling portion 721 is provided as the drum body 710 rotates and to space another end thereof opposite to the one end from the drum body 710 or to move the other end in a direction adjacent to the drum body 710.

Referring to FIG. 15, a connecting member coupling hole 721*a* with which the connecting member 740 is rotatably coupled may be provided at the blade coupling portion 721 of the drum blade 720. Fixed portions 712 which fix the connecting member 740 may be provided at both ends of the drum body 710.

In detail, while the drum blade 720 is mounted on the mounting groove 711 formed on the outer circumferential surface of the drum body 710, a central axis of a fixing groove portion 712*a* of the fixing portion 712 of the drum body 710 is disposed to be identical to a central axis of the connecting member coupling hole 721*a* of the drum blade 720. Here, a size of the blade coupling portion 721 of the drum blade 720 is provided to correspond to a size of the mounting portion 711 in such a way that the blade coupling portion 721 may be configured to be press fittingly inserted into the mounting portion 711. Accordingly, the drum blade 720 may rotate around the drum body 710 only when a force at a predetermined level or more is applied.

The connecting member 740 is inserted into the fixing portion hole 712*a* and the connecting member coupling hole 721*a*. Here, the connecting member 740 may be fixed to the fixing portion hole 712*a* not to rotate and may be rotatably coupled with the connecting member coupling hole 721*a*. Accordingly, the drum blade 720 may rotate around the drum body 710.

Referring to FIG. 16, the drum blade 720 may include a restricting portion 724 which protrudes from the blade coupling portion 721. The restricting portion 724 extends in a longitudinal direction of the drum blade 720 and is configured to interfere with the mounting portion 711 of the drum body 710. Accordingly, the drum blade 720 may be configured to rotate around the drum body 710 only at a predetermined angle.

Also, the drum blade 720, as shown in FIGS. 13 to 15, may be slanted in the longitudinal direction of the drum body 710. In detail, the drum blade 720 may be formed of two blade segments disposed to increasingly shift forward in the rotation direction going from a central portion to both ends the drum body 710 along the longitudinal direction. That is, when the drum 700 is viewed from a radial direction R, the drum blades 720 may be arranged in a V shape on the drum body 710. Accordingly, the connecting member 740 may be provided to rotatably connect the two blade segments with the drum body 710, respectively, and the drum body 710 may further include the fixing portion 712 for fixing the connecting members 740, respectively, in a central portion thereof. Due to a configuration described above, the drum blade 720 may guide dust present at both sides of the inlet 16 to a central portion of the inlet 16.

According to the configuration, the drum blade 720 of the drum 700 shown in FIGS. 13 to 16 may be unfolded outward from the drum body 710 in a radial direction R corresponding to a rotary speed of the drum body 710. In detail, when the drum body 710 rotates at a low speed, as shown in FIG. 14, the drum blade 720 may only be slightly unfolded outward in the radial direction R of the drum body 710. On the other hand, when the drum body 710 rotates at a high speed, as shown in FIG. 13, the drum blade 720 may be fully unfolded outward in the radial direction R of the drum body 710. That is, as the rotary speed of the drum body 710 decreases, a degree of unfolding from the drum body 710 may be reduced.

Also, the drum blade 720 unfolded toward a surface to be cleaned while rotating may be folded again by an interference portion 16*a* provided in the inlet 16 and may be moved into the case 10. That is, a size of a space within the case 10 in which the drum 700 is disposed may be smaller than a radius of the fully unfolded drum blade 720 and may be greater than a radius of the folded drum blade 720.

Like the embodiment shown in FIGS. 13 to 16, when the drum blade 720 is rotatably provided around the drum body 710, a degree at which the drum blade 720 is unfolded from the drum body 710 may be adjusted depending on the rotary speed of the drum body 710. Accordingly, when the drum body 710 rotates at a low speed, an area of the drum blade 720 in contact with the surface to be cleaned may be reduced. Accordingly, resistance between the drum blade 720 and the surface to be cleaned may be reduced, thereby reducing noise caused by friction between the drum blade 720 and the surface to be cleaned. In addition, power consumption for rotating the drum body 710 may be reduced.

Figure 17:
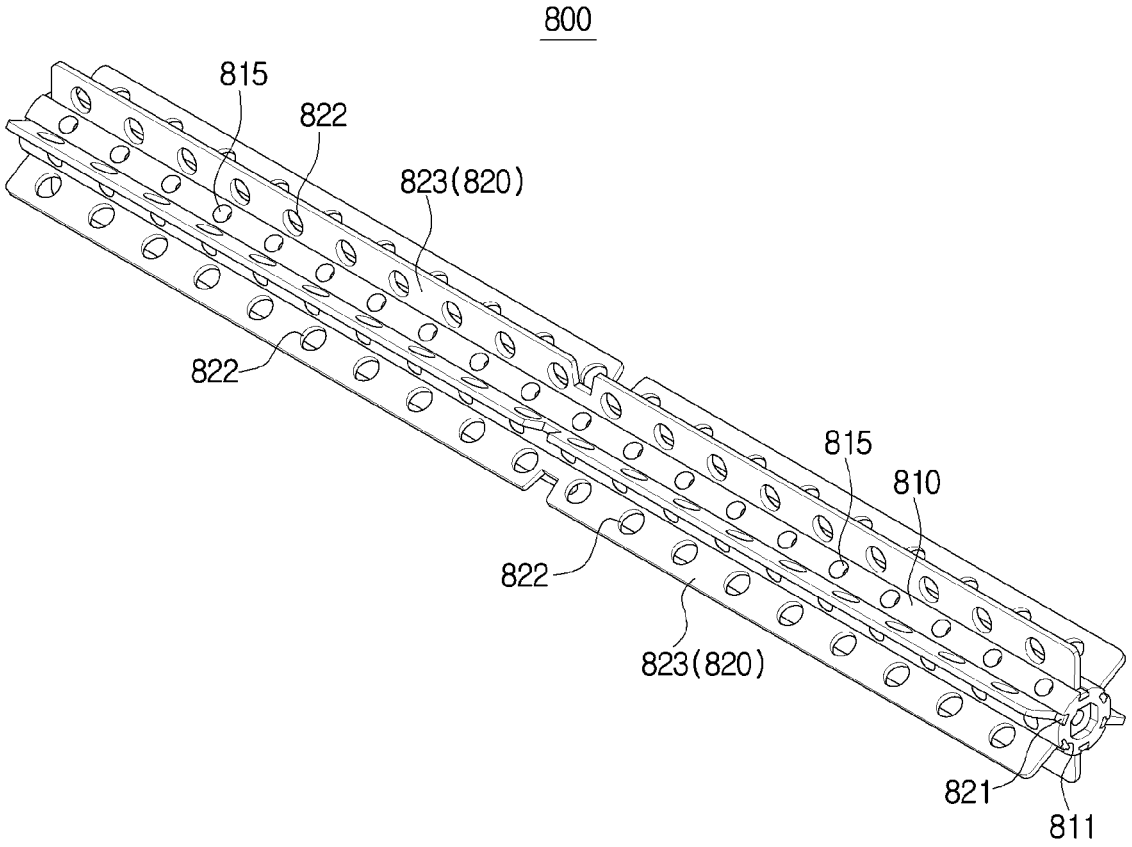
FIG. 17 is a view illustrating an example of the drum shown in FIG. 6.
Figure 18:
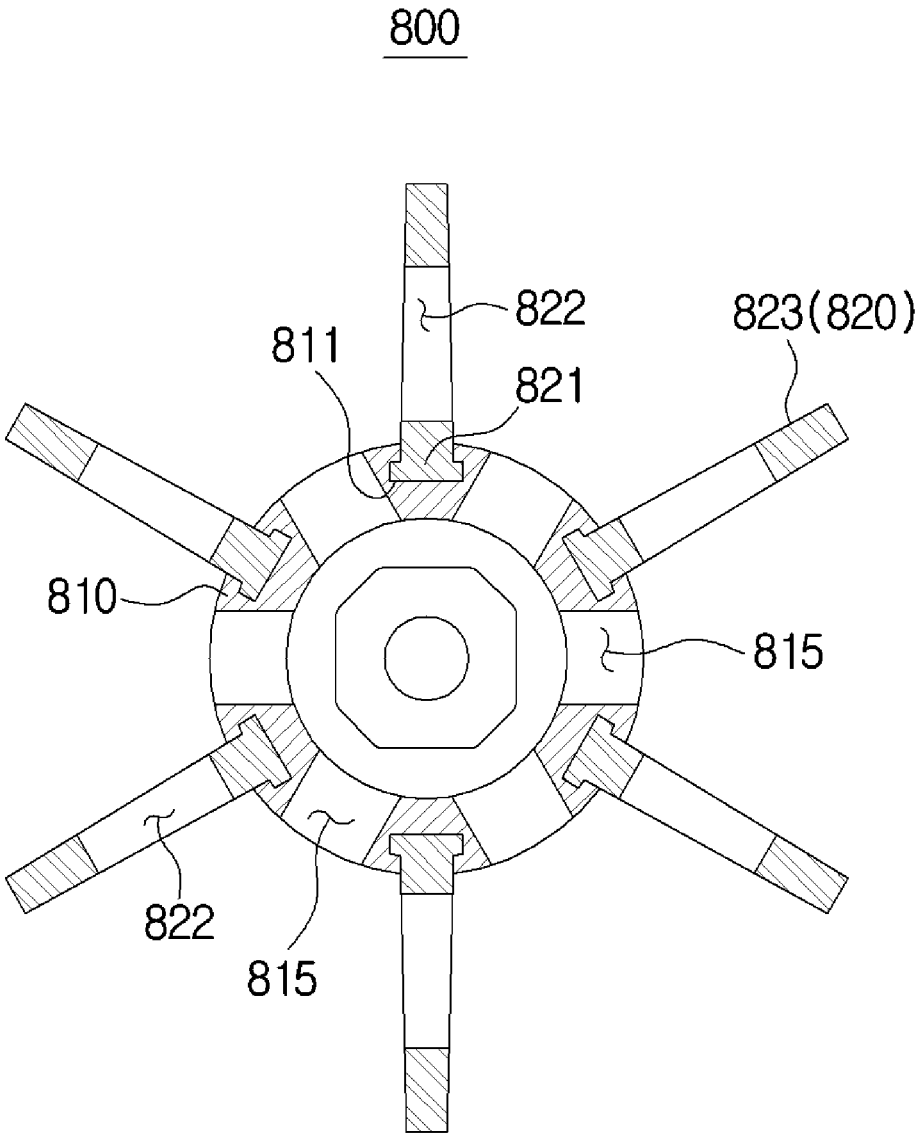
FIG. 18 is a cross-sectional view of the drum of FIG. 17 in a radial direction.
Figure 19:
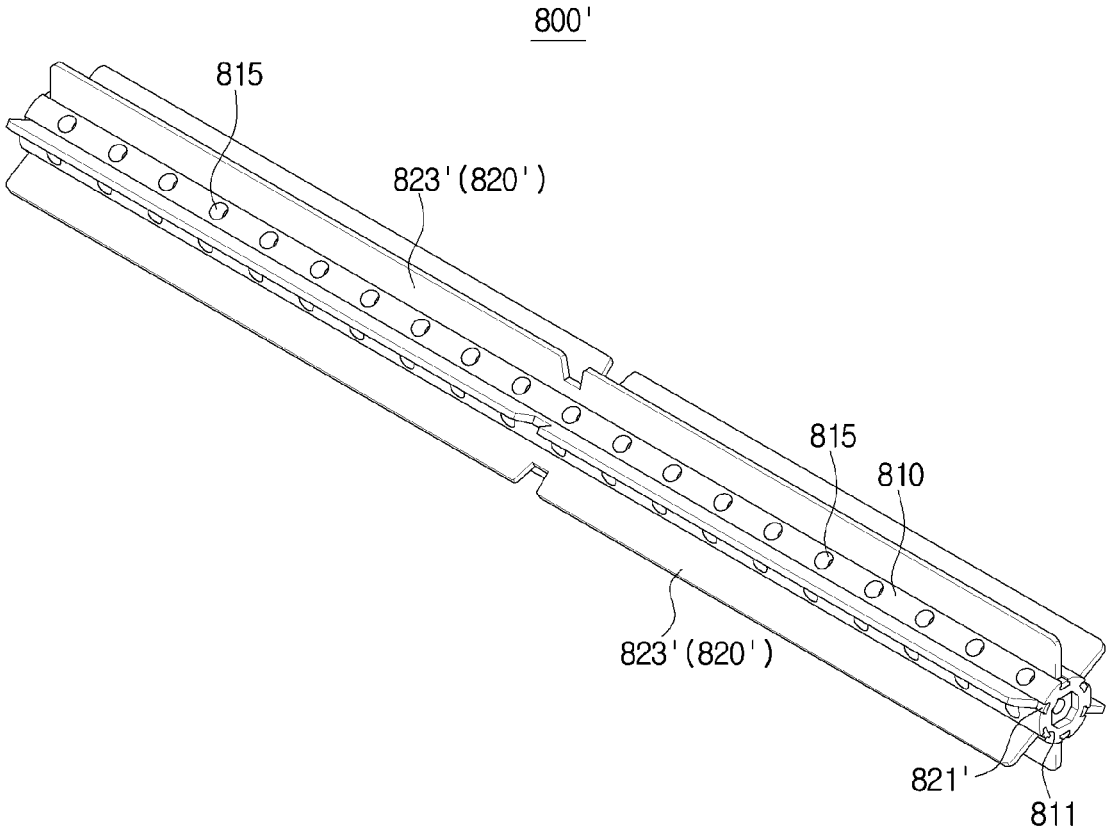
FIG. 19 is a view illustrating an example of the drum shown in FIG. 17.

FIG. 17 is a view illustrating an example of the drum 100 shown in FIG. 6. FIG. 18 is a cross-sectional view of a drum 800 shown in FIG. 17 in a radial direction R. FIG. 19 is a view illustrating an example of the drum 800 shown in FIG. 17.

Referring to FIGS. 17 and 18, the drum 800 includes a drum body 810 which rotates around an axis and a drum blade 820 provided on an outer circumferential surface of the drum body 810.

The drum body 810 may include a blade coupling groove 811 with which a blade coupling portion 821 of the drum blade 820 and a body air current hole 815 formed in an outer circumferential surface of the drum body 810 in a radial direction R of the drum body 810. A plurality of such body air current holes 815 may be provided in a longitudinal direction of the drum body 810. The body air current hole 815 may be formed in the outer circumferential surface of the drum body 810 not coupled with the drum blade 820. The body air current holes are formed in the whole outer circumferential surface of the drum body 810 not provided with the drum blades 820, that is, the whole outer circumferential surface between the drum blades 820 as shown in FIGS. 17 and 18, and six air current holes 815 are shown in a cross-sectional view in the radial direction R of the drum body 810 in FIG. 18 but are not limited thereto and may be provided at a part of the outer circumferential surface. In addition, a shape of the body air current hole 815 may be a hexagon as shown in FIGS. 8 and 9 and may be a polygon or oval. That is, there is no limit in shape and number of the body air current holes 815.

The drum blade 820 is coupled and fixed by coupling the blade coupling portion 821 provided on one end thereof with the blade coupling groove 811 of the drum body 810. The drum blade 820 may include a blade air current hole 822, like the drum blade 120 shown in FIG. 6. Meanwhile, as shown in FIG. 19, a drum blade 820' of a drum 800' may be configured without blade air current holes. That is, the drum blade 820' may include a blade coupling portion 821' at one end thereof and a blade body 823' may have a simple plate shape.

When the body air current hole 815 are provided in the drum body 810 like the example shown in FIGS. 17 and 18, because it is possible to provide more flow channels capable of inducing rubbish on a surface to be cleaned and air into the dust collecting member 50 rather than the conventional types, cleaning efficiency may be improved.

Figure 20:
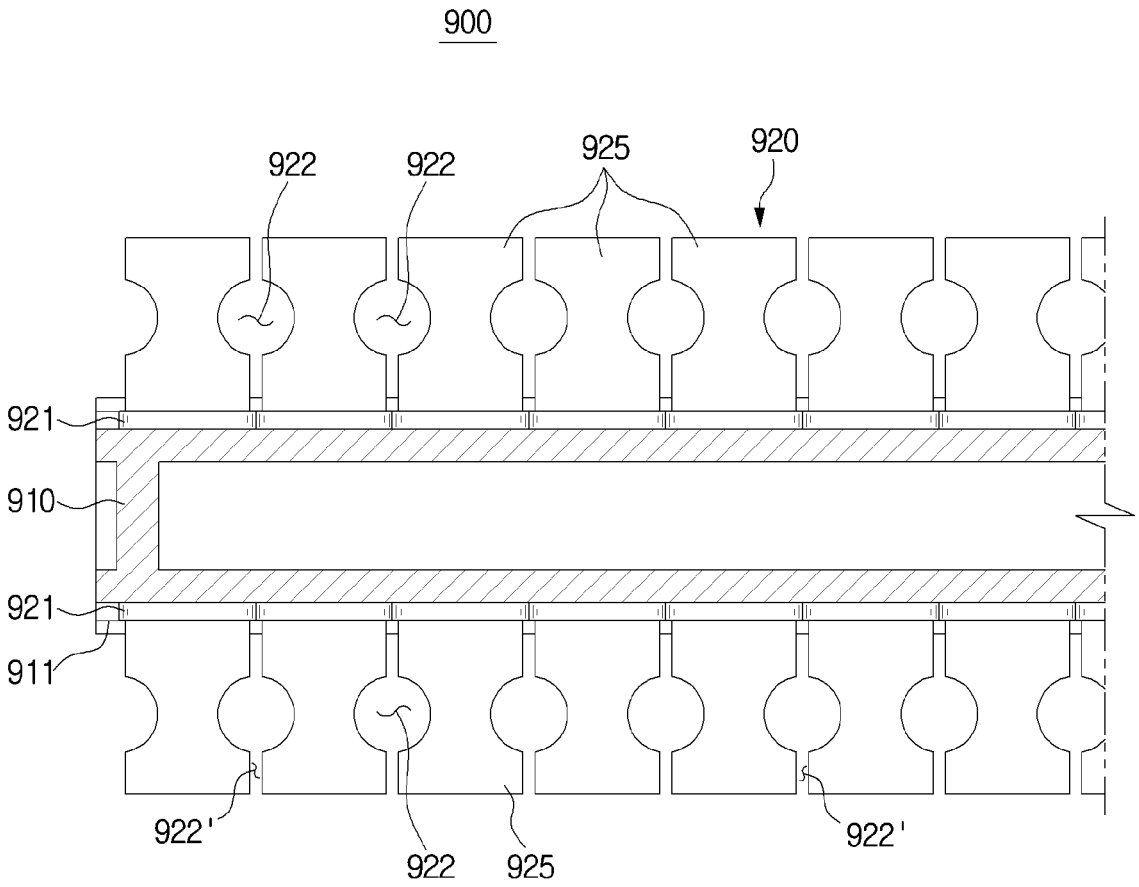
FIG. 20 is a view illustrating an example of the drum shown in FIG. 6.

FIG. 20 is a view illustrating a further example of the drum 100 shown in FIG. 6.

Referring to FIG. 20, a drum 900 includes a drum body 910 which rotates around an axis and a drum blade 920 provided on an outer circumferential surface of the drum body 910.

The drum body 910 may include a blade coupling groove 911 on the outer circumferential surface, to which a blade coupling portion 921 of the drum blade 920 is coupled and fixed.

The drum blade 920 may include a plurality of segments 925 spaced at predetermined intervals in a longitudinal direction of the drum body 910. The blade segments 925 extend outward from the blade coupling portion 921 in a radial direction R of the drum body 910. Mutually adjacent sides of the blade segments 925 are formed to be concave, thereby forming a blade air current hole 922. In another view, the blade segments 925 may be disposed on both sides of the blade air current hole 922. As the blade segments 925 are arranged to be mutually spaced apart, a blade air current slit 922' may be provided between the respective blade segments 925.

When the drum blade 920 includes the plurality of blade segments 925 like the example shown in FIG. 20, the blade air current slit 922' may be provided between the respective blade segments 925 to provide more flow channels for inducting rubbish on an area to be cleaned and air into the dust collecting member 50, thereby improving cleaning efficiency. In addition, it may be easy to maintain and repair the respective blade segments 925.

Figure 21:
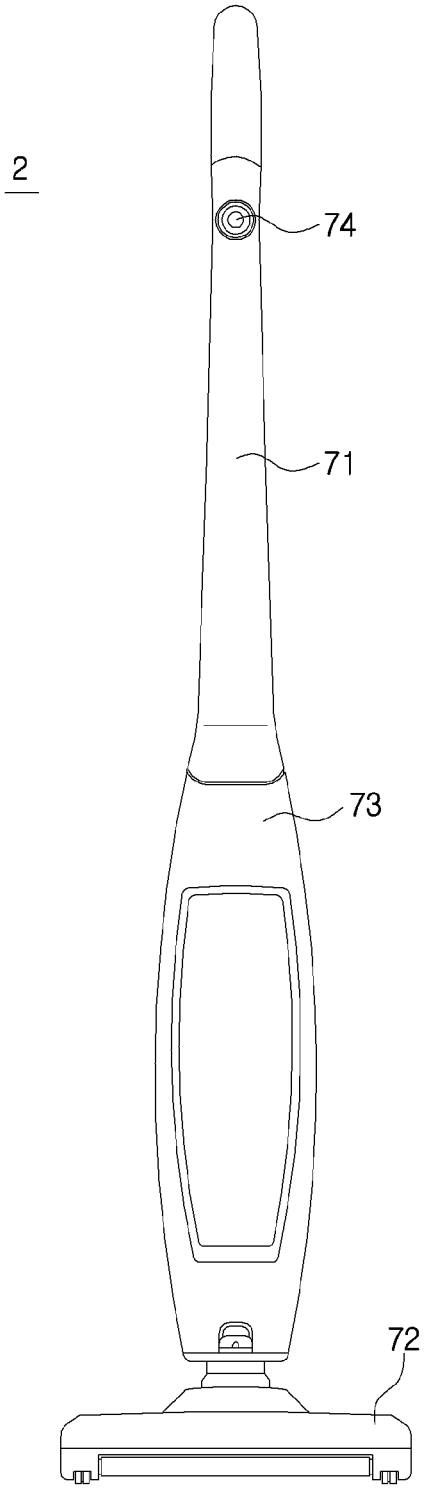
FIG. 21 is a view of a cleaner in accordance with an embodiment of the present disclosure.
Figure 22:
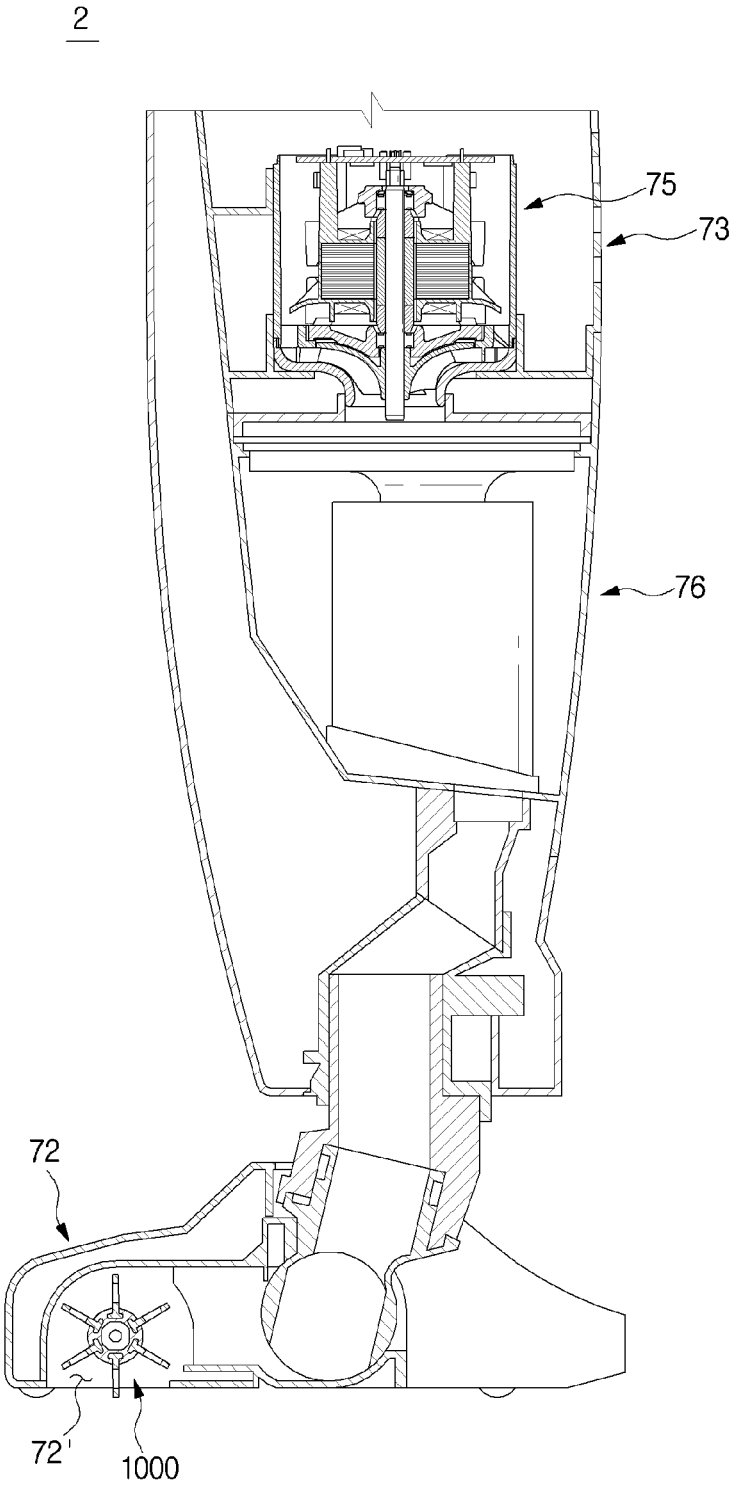
FIG. 22 is a cross-sectional view illustrating some components of the cleaner of FIG. 21.

FIG. 21 is a view of a cleaner 2 in accordance with an embodiment of the present disclosure. FIG. 22 is a cross-sectional view illustrating some components of the cleaner 2 of FIG. 21.

Referring to FIG. 21, the cleaner 2 includes a stick body 71, an inlet portion 72, and a cleaner body 73.

The stick body 71 is a part coupled with a top end of the cleaner body 73 and may be provided to allow the user to grip the cleaner 2 to operate. The stick body 71 includes a control portion 74 provided to allow the user to control the cleaner 2.

The inlet portion 72 is provided below the cleaner body 73 and is arranged to be in contact with a surface to be cleaned. The inlet portion 72 includes an inlet 72' provided to be in contact with the surface to be cleaned and to allow dust or rubbish on the surface to be cleaned to flow into the cleaner body 73 using a suction force generated by a motor assembly 75.

The cleaner body 73 includes the motor assembly 75 and a dust box 76 provided therein. The motor assembly 75 is provided to generate power to generate the suction force in the cleaner body 73. The dust box 76 is disposed in an upper portion of an air flow compared to the motor assembly 75, to filter out and collect dust or rubbish in the air which flows through the inlet 72'.

A drum 1000 may be provided in the inlet portion 72. The drum 1000 shown in FIG. 22 may be provided to have the same configuration as those of the drums 100, 200, 300, 400, 500, 600, 700, 800, and 900 shown in FIGS. 6 to 20. Accordingly a detailed description thereof will be omitted.

Like the example shown in FIGS. 21 and 22, in the case of the cleaner 2 which is an upright type, the drums 100, 200, 300, 400, 500, 600, 700, 800, and 900 shown in FIGS. 6 to 20 may be applied. Accordingly, cleaning efficiency of the cleaner 2 may be improved, noise caused by friction between the drum 1000 and a surface to be cleaned may be reduced by reducing an area of the drum 1000 in contact with the surface to be cleaned, and power consumption for driving the drum 1000 may be reduced.

Figure 23:
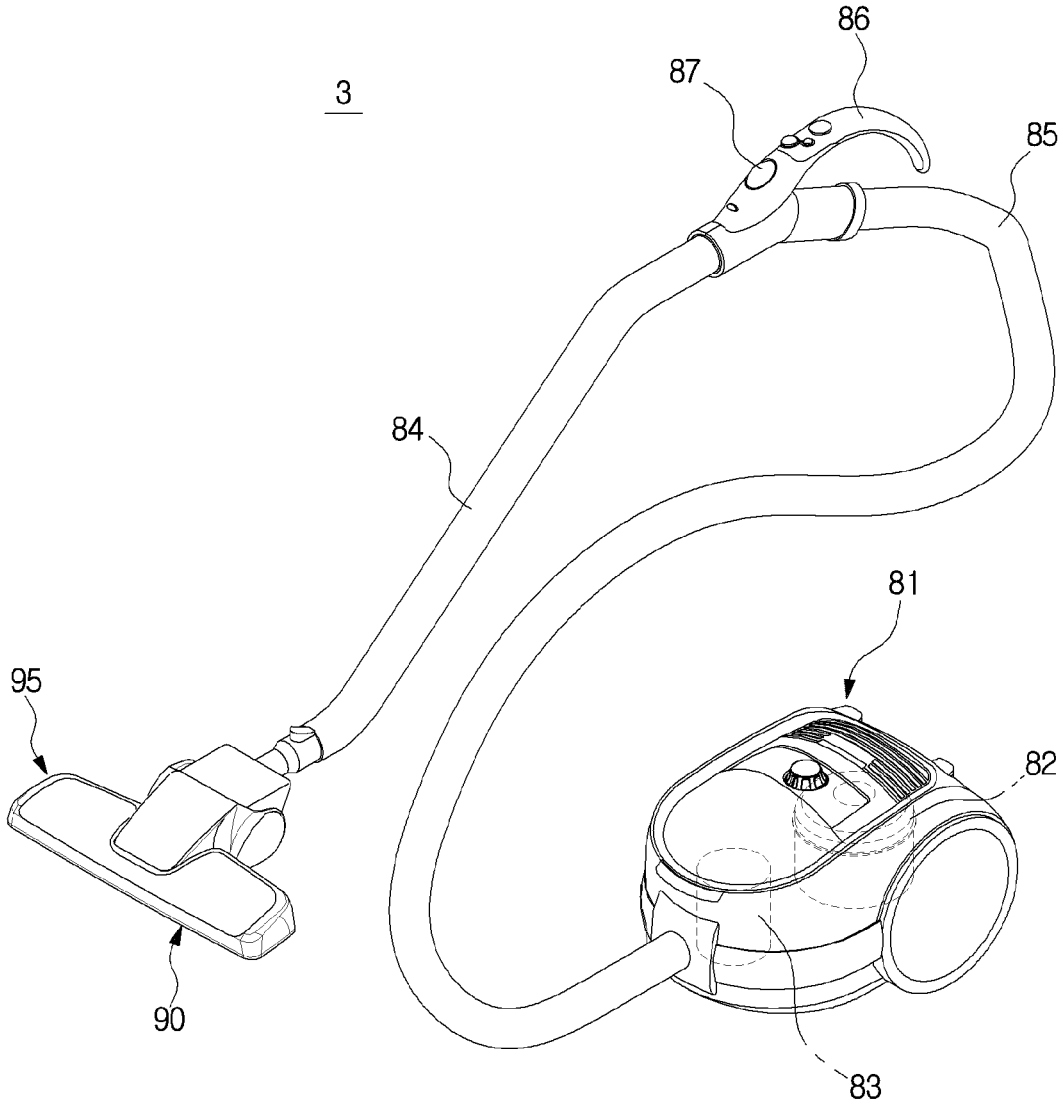
FIG. 23 is a view of a cleaner in accordance with an embodiment of the present disclosure.
Figure 24:
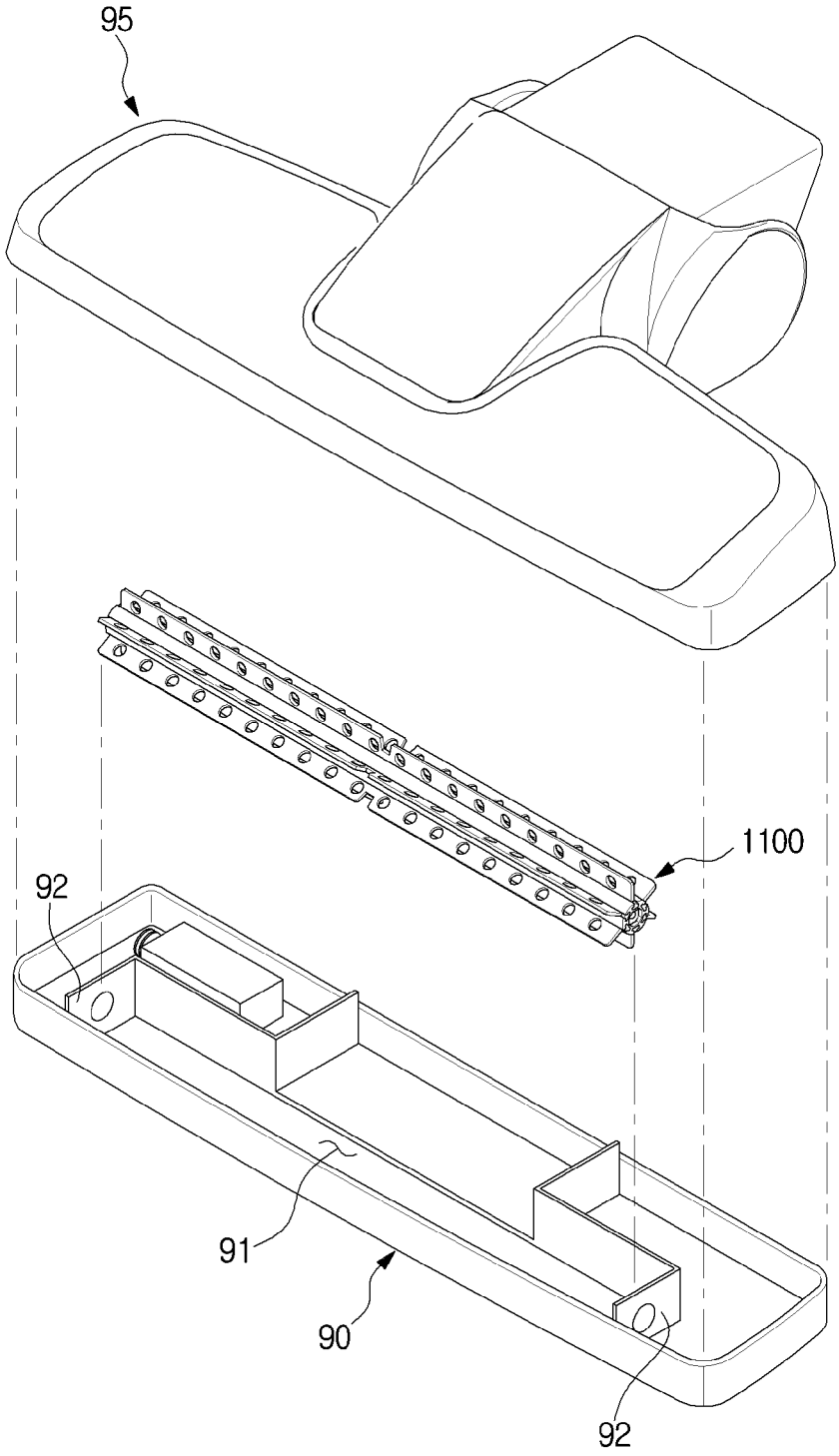
FIG. 24 is an exploded perspective view illustrating a main part of the cleaner of FIG. 23.

FIG. 23 is a view of a cleaner 3 in accordance with an embodiment of the present disclosure. FIG. 24 is an exploded perspective view illustrating a main part of the cleaner 3 of FIG. 23.

Referring to FIGS. 23 and 24, the cleaner 3 may include a fan motor 82 which generates a suction force, a body 81 having a dust collecting member 83 which separates and collects rubbish from suctioned air, a lower case 90 provided with an inlet 91 which suctions the air from a surface to be cleaned, an upper case 95 provided above the lower case 90 to cover the lower case 90 not to expose an inside of the lower case 90, a connection pipe 84 connected to the upper case 95 to transfer the air suctioned at the inlet 91 to the body 81, and a connection hose 85 which connects the connection pipe 84 with the body 81.

The dust collecting member 83 may be a cyclone type which separates rubbish using a centrifugal force, a dust box type which allows air to pass through a filter box to filter out rubbish, or may be any one of various well-known types capable of separating rubbish. The air purified and separated from the rubbish by the dust collecting member 83 may be discharged from the body 81.

The connection pipe 84 may be provided to have a predetermined level of stiffness, and the connection hose 85 may be formed of a flexible material.

A handle 86 to be gripped by the user may be provided between the connection pipe 84 and the connection hose 85. A plurality of operation buttons 87 for operating the cleaner 3 may be provided on the handle 86.

The lower case 90 includes the inlet 91 which suctions the air from the surface to be cleaned. A drum 1100 which allows dust on a floor to float by scrubbing or beating the surface to be cleaned is provided in the lower case 90. Supporting portions 92 are provided on both sides to rotatably support the drum 1100.

The drum 1100 applied to the embodiment may be provided to have the same configuration as those of the drums 100, 200, 300, 400, 500, 600, 700, 800, and 900 shown in FIGS. 6 to 20. Accordingly a detailed description thereof will be omitted.

The inlet 91 is provided below the lower case 90, through which the dust floating on the floor due to the drum 1100 is suctioned together with the air and is transferred to the connection pipe 84 connected to the upper case 95. The air transferred to the connection pipe 84 passes through the connection hose 85 and is transferred to the body 81.

Like the example shown in FIGS. 23 and 24, in the case of the cleaner 3 which is a canister type, the drums 100, 200, 300, 400, 500, 600, 700, 800, and 900 shown in FIGS. 6 to 20 may be applied. Accordingly, cleaning efficiency of the cleaner 3 may be improved, noise caused by friction between the drum 1100 and the surface to be cleaned may be reduced by reducing an area of the drum 1100 in contact with the surface to be cleaned, and power consumption for driving the drum 1100 may be reduced.

As described above, the cleaners 1, 2, and 3 may increase the cleaning efficiency by providing a flow channel of rubbish and/or air which flows through the inlets 16 and 91 and the inlet portion 72, respectively. Also, the resistance and friction between the drums 100, 200, 300, 400, 500, 600, 700, 800, 900, 1000, and 1100 and the surface to be cleaned may be reduced by reducing the contact areas between the drums 100, 200, 300, 400, 500, 600, 700, 800, 900, 1000, and 1100 and the surface to be cleaned. Accordingly, the noise caused between the drums 100, 200, 300, 400, 500, 600, 700, 800, 900, 1000, and 1100 and the surface to be cleaned may be reduced and the power consumption for driving the drums 100, 200, 300, 400, 500, 600, 700, 800, 900, 1000, and 1100 may be reduced.

As is apparent from the above description, a cleaner in accordance with an embodiment of the present disclosure improves cleaning performance.

The cleaner may prevent a tangle of fibrous dust using a drum blade.

The cleaner may provide a flow channel to allow rubbish and/or air suctioned by air current holes provided in a drum through an inlet to move into the cleaner, thereby improving cleaning performance.

The cleaner may reduce noise by reducing a contact area between the drum blade and a floor surface.

The cleaner may reduce power consumption by reducing a contact area between the drum blade and a floor surface.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A cleaner comprising:

a case including an inlet to suction air and rubbish on a surface to be cleaned;

a driver provided inside the case and including a motor to generate power;

a drum body provided in the inlet and configured to receive the power from the driver and rotate;

a plate blade extending outward from an outer circumference of the drum body in a radial direction of the drum body, the plate blade being disposed between two of a plurality of drum blades along the outer circumference of the drum body; and a drum blade provided along the outer circumference of the drum body and including a blade air current hole configured to allow the air and rubbish suctioned into the inlet to pass through.

2. The cleaner of claim 1, wherein the drum blade extends outward from the outer circumference of the drum body in the radial direction of the drum body to contact the surface to be cleaned.

3. The cleaner of claim 1, wherein the blade air current hole is among a plurality of blade air current holes provided along a longitudinal direction of the drum body.

4. The cleaner of claim 1, wherein the drum blade is among the plurality of drum blades arranged along the outer circumference of the drum body.

5. The cleaner of claim 4, further comprising:

a drum brush provided between at least two of the plurality of drum blades along the outer circumference of the drum body and including at least one brush extending outward from the outer circumference of the drum body in the radial direction of the drum body.

6. The cleaner of claim 1, wherein the blade air current hole is provided in at least one of a circular shape and a honeycomb shape.

7. The cleaner of claim 1, wherein the drum blade includes a viscoelastic material.

8. The cleaner of claim 1, wherein the drum body further comprises a body air current hole penetrating the drum body in a radial direction thereof.

9. The cleaner of claim 8, wherein the body air current hole is among a plurality of body air current holes provided in a longitudinal direction of the drum body.

10. The cleaner of claim 1, wherein one end of the drum blade is rotatably connected to the drum body to allow the drum blade to rotate around the one end as the drum body rotates and another end opposite the one end is pointing away from the drum body.

11. The cleaner of claim 10, further comprising a connecting member which rotatably connects the drum blade with the drum body, wherein the drum blade comprises a blade connecting portion provided at the one end to allow the connecting member to be rotatably coupled therewith, and wherein the drum body comprises fixing portions which fix the connecting member at both ends thereof.

12. The cleaner of claim 11, wherein the drum body comprises a mounting groove on the outer circumference of the drum body, on which the drum blade is rotatably mounted.

13. The cleaner of claim 10, wherein the drum blade comprises a restricting portion which restricts a rotation of the drum blade about the drum body.

14. The cleaner of claim 10, wherein the drum blade is slanted along a longitudinal direction of the drum body.

15. The cleaner of claim 1, wherein the drum blade comprises a plurality of blade segments disposed on both sides of the blade air current hole in a longitudinal direction of the drum body.

16. A cleaner comprising:

a case including an inlet to suction air and rubbish on a surface to be cleaned;

a driver provided inside the case and including a motor to generate power;

a drum body provided in the inlet and configured to receive the power from the driver and rotate;

a plate blade extending outward from an outer circumference of the drum body in a radial direction of the drum body, the plate blade being disposed between two of a plurality of drum blades along the outer circumference of the drum body; and a drum blade with one end rotatably connected to the drum body and rotatable outward in the radial direction of the drum body.

17. The cleaner of claim 16, further comprising a connecting member which rotatably connects the drum blade with the drum body, wherein the drum blade includes a connecting member coupling hole provided at the one end to allow the connecting member to be rotatably coupled therewith, and wherein the drum body includes fixing portions which fix the connecting member on the outer circumference of the drum body.

18. The cleaner of claim 16, wherein the drum body includes a mounting groove on the outer circumference of the drum body, on which the drum blade is rotatably mounted.

19. A drum for a cleaner, comprising:

a drum body having a cylindrical shape;

a plate blade extending outward from an outer circumference of the drum body in a radial direction of the drum body, the plate blade being disposed between two of a plurality of drum blades along the outer circumference of the drum body;

a drum blade extending outward from the outer circumference of the drum body in the radial direction of the drum body; and at least one blade air current hole provided in the drum blade.

20. The drum of claim 19, further comprising a connecting member which rotatably couples the drum blade with the drum body.

21. The drum of claim 20, wherein the drum blade includes a blade coupling portion at one end connected to the drum body to allow the connecting member to be rotatably coupled therewith, and wherein the drum body comprises a fixing portion which fixes the connecting member on the outer circumference of the drum body.

22. The drum of claim 20, wherein the drum body includes a mounting groove on the outer circumference of the drum body, on which the drum blade is rotatably mounted.

23. A vacuum cleaner comprising:

a motor to generate a suction force;

a case including an inlet to provide the suction force near a surface to be cleaned;

a rotatable drum provided in the inlet and configured to rotate around an axis substantially parallel with the surface to be cleaned;

a plate blade extending outward from an outer circumference of the rotatable drum in a radial direction of the rotatable drum, the plate blade being disposed between two of the plurality of drum blades along the outer circumference of the drum body; and a drum blade extending from the outer circumference of the rotatable drum, wherein at least one of the rotatable drum and the drum blade includes an air current hole configured to allow the suction force to be provided in a direction opposite to a direction of rotation of the rotatable drum.

* * * * *